US007837293B2

(12) United States Patent
Hayashi et al.

(10) Patent No.: US 7,837,293 B2
(45) Date of Patent: Nov. 23, 2010

(54) SUCTION DEVICE AND LIQUID DROPLET EJECTION APPARATUS HAVING THE SAME, AS WELL AS ELECTRO-OPTICAL APPARATUS AND MANUFACTURING METHOD THEREOF

(75) Inventors: Chiyoshi Hayashi, Okaya (JP); Chieko Iuchi, Suwa (JP)

(73) Assignee: Seiko Epson Corporation (JP)

( * ) Notice: Subject to any disclaimer, the term of this patent is extended or adjusted under 35 U.S.C. 154(b) by 205 days.

(21) Appl. No.: 12/197,474

(22) Filed: Aug. 25, 2008

(65) Prior Publication Data

US 2009/0058915 A1 Mar. 5, 2009

(30) Foreign Application Priority Data

Aug. 30, 2007 (JP) ..... 2007-224524

(51) Int. Cl.
*B41J 2/165* (2006.01)

(52) U.S. Cl. ..... 347/30; 347/29; 347/23; 347/32; 347/36

(58) Field of Classification Search ..... 347/23, 347/24, 29, 30, 32, 36
See application file for complete search history.

(56) References Cited

U.S. PATENT DOCUMENTS 5,625,385 A * 4/1997 Suzuki ..... 347/24
6,494,560 B1 * 12/2002 Seshimo et al. ..... 347/23
2004/0137159 A1 7/2004 Nakamura et al.

FOREIGN PATENT DOCUMENTS

| | | |
|---|---|---|
| JP | 2001-315358 | 11/2001 |
| JP | 2004-209461 | 7/2004 |
| JP | 2005-169235 | 6/2005 |
| JP | 2005-254798 | 9/2005 |

* cited by examiner

*Primary Examiner*—Shih-wen Hsieh
(74) *Attorney, Agent, or Firm*—Harness, Dickey & Pierce, P.L.C.

(57) ABSTRACT

Provided herein is a suction device that is provided in an inkjet liquid droplet ejection apparatus and sucks functional liquid while contacting with nozzle surfaces of the functional liquid droplet ejection heads. The suction device has a plurality of head caps, a suction channel having a plurality of individual channels, a plurality of channel opening/closing unit that is disposed on the individual channels and opens and closes the respective individual channels, a waste liquid tank, an ejector, a pressure adjustment unit that adjusts pressure of the compressed air at the primary side of the ejector, and a control unit that controls the pressure adjustment unit. The control unit controls the pressure adjustment unit according to the number of open-channel opening/closing units opened out of the plurality of channel opening/closing units such that a suction pressure is constant in the plurality of head caps.

7 Claims, 29 Drawing Sheets

SUCTION DEVICE AND LIQUID DROPLET EJECTION APPARATUS HAVING THE SAME, AS WELL AS ELECTRO-OPTICAL APPARATUS AND MANUFACTURING METHOD THEREOF

The entire disclosure of Japanese Patent Application No. 2007-224524, filed Aug. 30, 2007, is expressly incorporated by reference herein.

BACKGROUND

1. Technical Field

The present invention relates to a suction device that has a plurality of head caps capable of closely contacting with and moving away from corresponding nozzle surfaces of a plurality of inkjet functional liquid droplet ejection heads, and a liquid droplet ejection apparatus having the suction device, as well as an electro-optical apparatus and a manufacturing method thereof.

2. Related Art

It is known that suction devices have seven suction units having twelve head caps mounted thereon, corresponding to seven carriage units having twelve functional liquid droplet ejection heads mounted thereon (see, for example, JP-A-2005-254798).

Each suction unit includes a cap unit that has twelve head caps mounted on a cap plate, a contacting/separating mechanism that contacts/moves the twelve head caps with/away from twelve functional liquid droplet ejection heads by using the cap plate, a waste liquid tank that communicates to the twelve head caps, an ejector that has a secondary side connected to the waste liquid tank to apply suction pressure to the waste liquid tank, and a suction channel that connects the twelve head caps to the waste liquid tank.

When compressed air is introduced to a primary side of the ejector to drive the ejector while the head caps are closely contacted with their corresponding functional liquid droplet ejection heads, inside the waste liquid tank and the suction channel are under negative pressure so that the functional liquid is sucked from the twelve functional liquid droplet ejection heads via the twelve head caps.

In such suction devices, when some functional liquid droplet ejection heads out of the twelve functional liquid droplet ejection heads require suction because of clogging and the like while others do not, the devices collectively perform suction process so that functional liquid is wasted. In such a case, it is conceivable that an open/close valve is disposed on an individual suction channel in each of the functional liquid droplet ejection heads to suck only the functional liquid droplet ejection heads that need to be sucked.

However, it is presumed that, in this configuration, if the number of the functional liquid droplet ejection heads subjected to the suction is changed, suction force in each head caps is varied (change in suction flow rate), which can make it impossible to appropriately suck each functional liquid droplet ejection head.

SUMMARY

An advantage of some aspects of the invention is to provide a suction device that performs suction under the same suction pressure in each head cap even if the number of the head caps which are concurrently subjected to a suction process is changed, and also to provide a liquid droplet ejection apparatus having the suction device, an electro-optical apparatus, and a manufacturing method thereof.

According to one aspect of the invention, a suction device is installed in an inkjet liquid droplet ejection apparatus to plot on a workpiece by a plurality of functional liquid droplet ejection heads and sucks functional liquid while contacting with nozzle surfaces of the functional liquid droplet ejection heads, and the suction device includes a plurality of head caps corresponding to the functional liquid droplet ejection heads, a suction channel having a plurality of individual channels having their upstream sides connected to the head caps and a junction channel connected to the downstream ends of the individual channels via a junction part, a plurality of channel opening/closing unit that is disposed on the individual channels and opens and closes the individual channels, a waste liquid tank connected to the downstream end of the junction channel and composed of a sealed tank, an ejector having a primary side with compressed air introduced thereto and a secondary side connected to an upper space of the waste liquid tank, a pressure adjustment unit that adjusts pressure of the compressed air at the primary side of the ejector, and a control unit that controls the pressure adjustment unit, in which the control unit controls the pressure adjustment unit according to the number of open-channel opening/closing units opened out of the channel opening/closing units such that a suction pressure is constant in the head caps.

With this configuration, the suction process can be conducted by opening and closing the channel opening/closing units when some functional liquid droplet ejection heads conduct the suction process and others do not, and the suction pressure can be constant in each of the head caps by controlling a regulator according to the number of the open-channel opening/closing units opened. This allows the suction flow rate of the head caps to be constant independently of the number of functional liquid droplet ejection heads subjected to the suction process. Further, a system having excellent chemical resistance to the functional liquid can be established by using the ejector as a suction source.

It is preferable that the suction device further have a pressure detection unit that detects pressure in each of the waste liquid tanks during suction, and the control unit control the pressure adjustment unit such that the pressure in the waste liquid tank is set to be a predetermined pressure according to the number of the channel opening/closing unit opened.

It is also preferable that the suction device further have a flow rate detection unit that detects a flow rate of functional liquid flowing into each of the waste liquid tanks by suction, and the control unit control the pressure adjustment unit such that the flow rate of the functional liquid flowing into the waste liquid tanks is set to be a predetermined flow rate according to the number of the channel opening/closing unit opened.

With this configuration, any of the head caps can be accurately controlled to make the suction pressure constant at anytime, whereby the functional liquid droplet ejection heads can be appropriately subjected to the suction process in consideration of the types of functional liquids.

It is preferable that the functional liquid droplet ejection heads be mounted on a single head plate and the head caps be mounted on a single cap plate in a manner corresponding to the functional liquid droplet ejection heads.

With this configuration, the suction process can be appropriately conducted to the functional liquid droplet ejection heads mounted on the single head plate even when some functional liquid droplet ejection heads conduct the suction process and others do not.

It is also preferable that the functional liquid droplet ejection heads be mounted on a plurality of head plates and the head caps be mounted on a plurality of cap plates in a manner corresponding to the functional liquid droplet ejection heads.

With this configuration, the suction process can be appropriately conducted to the functional liquid droplet ejection heads mounted on the head plates even when some functional liquid droplet ejection heads conduct the suction process and others do not.

According to another aspect of the invention, a liquid droplet ejection apparatus includes a plotting unit that plots on a workpiece by ejecting functional liquid droplets from a plurality of inkjet functional liquid droplet ejection heads while moving the functional liquid droplet ejection heads, and the above-described suction device.

With this configuration, since the function of the functional liquid droplet ejection heads can be appropriately maintained and recovered, a process of the workpiece can be conducted by plotting with high quality, resulting in improved productivity.

According to a further aspect of the invention, a manufacturing method of an electro-optical apparatus includes forming a film formation portion on a workpiece with functional liquid droplets by using the above-described liquid droplet ejection apparatus.

According to a still further according to an aspect of the invention, an electro-optical apparatus includes a film formation portion formed on a workpiece with functional liquid droplets by using the above-described liquid droplet ejection apparatus.

With this configuration, since the liquid droplet ejection apparatus is manufactured in which the function of the functional liquid droplet ejection heads is efficiently maintained and recovered, thereby improving productivity of the workpiece. The electro-optical apparatus (flat panel display: FDP) may include color filters, liquid crystal displays, organic electroluminescence devices, plasma display panels (PDPs), and electron emission apparatuses. The conception of the electron emission apparatuses includes so-called field emission displays (FEDs), surface-conduction electron-emitter displays (SEDs) and the like. Further, it is conceivable that the electro-optical apparatus includes devices that form metal wiring, lenses, photoresists, and light diffusers.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will now be described with reference to the accompanying drawings in which the functional liquid supply device according to the invention is applied to a liquid droplet ejection apparatus. The liquid droplet ejection apparatus is installed in a manufacturing line for flat panel displays where, for example, functional liquid droplet ejection heads to which functional liquid such as special inks and luminescent resin liquids is introduced are used to form color filters for liquid crystal displays or light emitting elements constituting pixels of organic electroluminescence devices.

Figure 1:
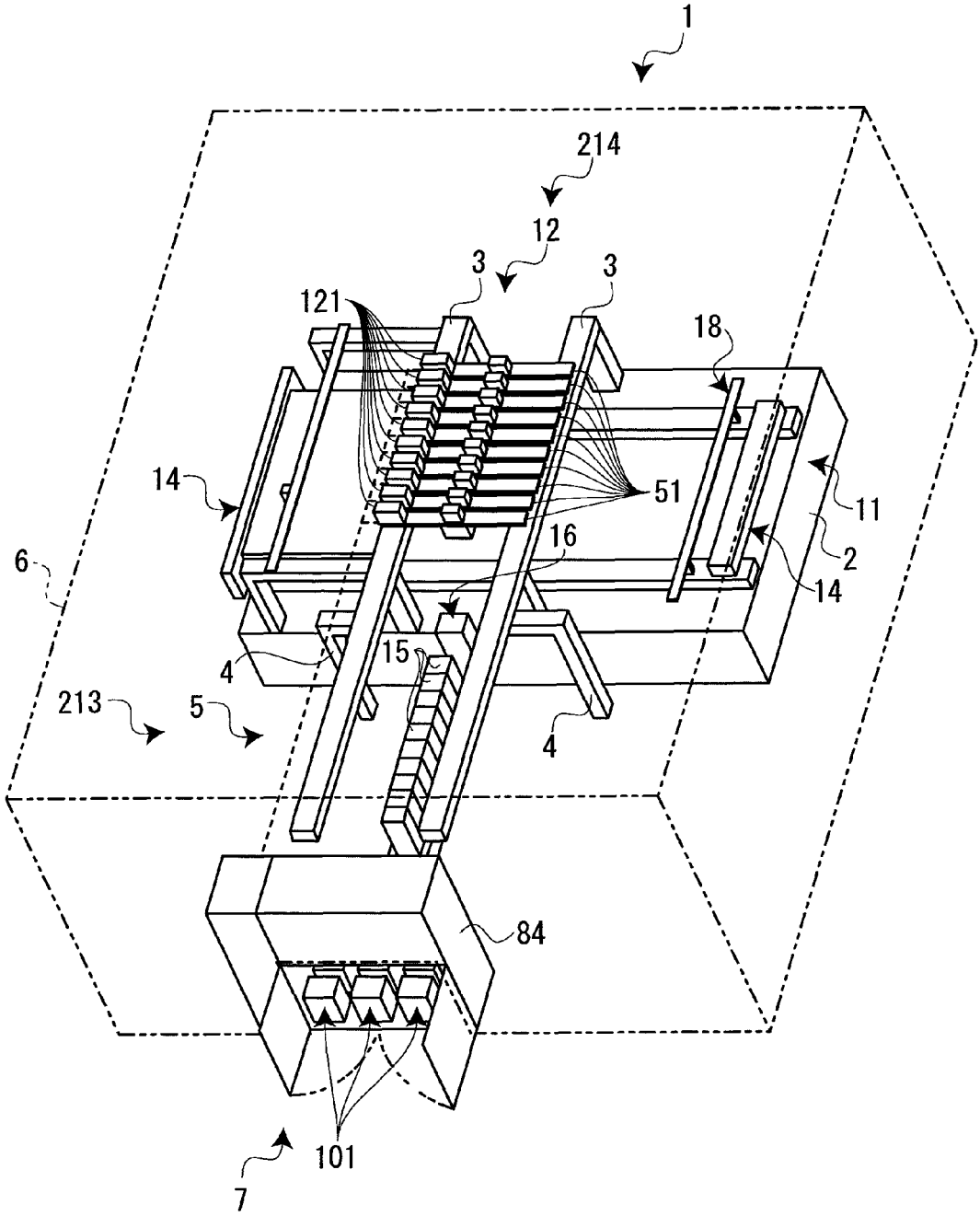
FIG. 1 is a perspective view of a liquid droplet ejection apparatus according to an embodiment.
Figure 2:
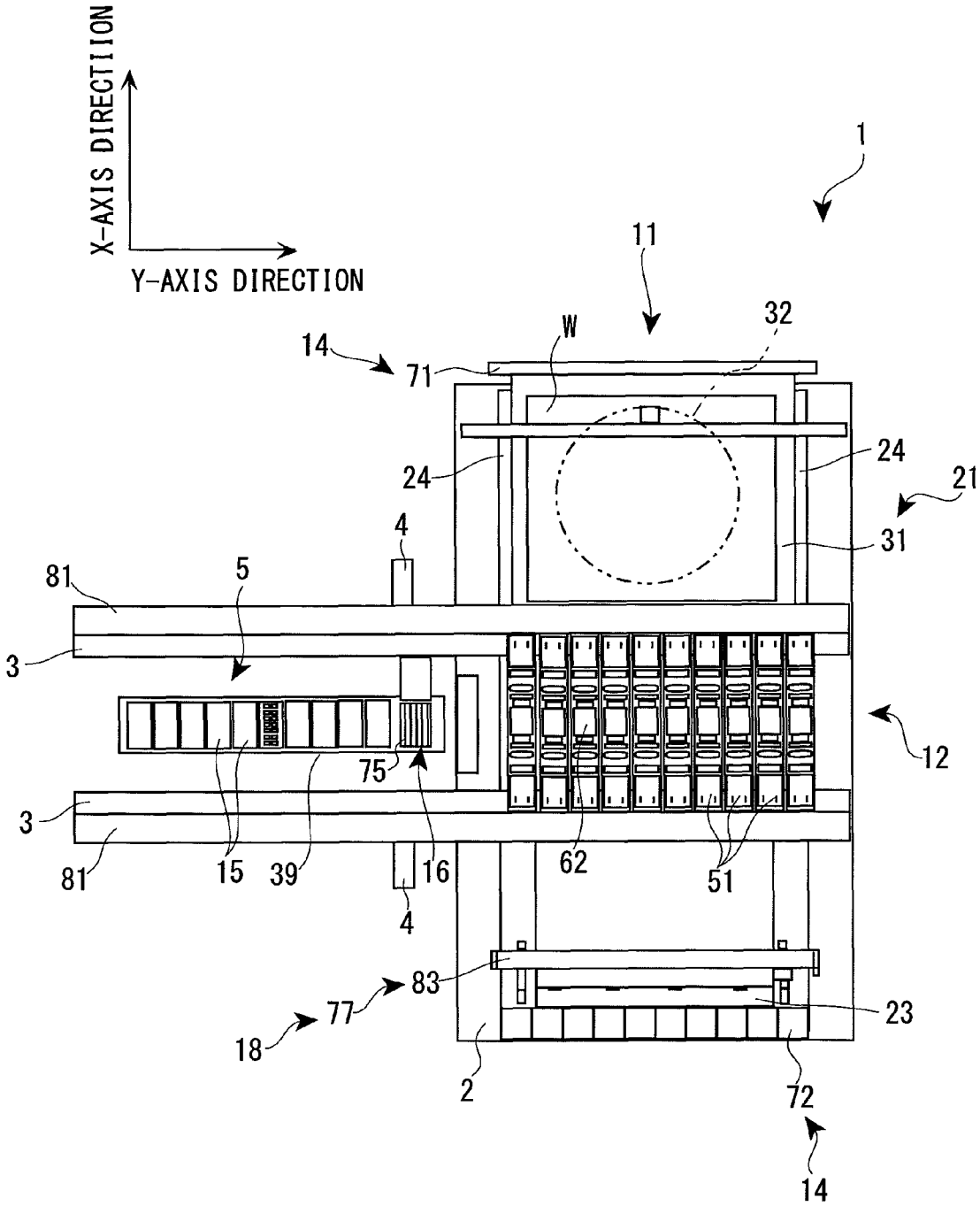
FIG. 2 is a plan view of the liquid droplet ejection apparatus.
Figure 3:
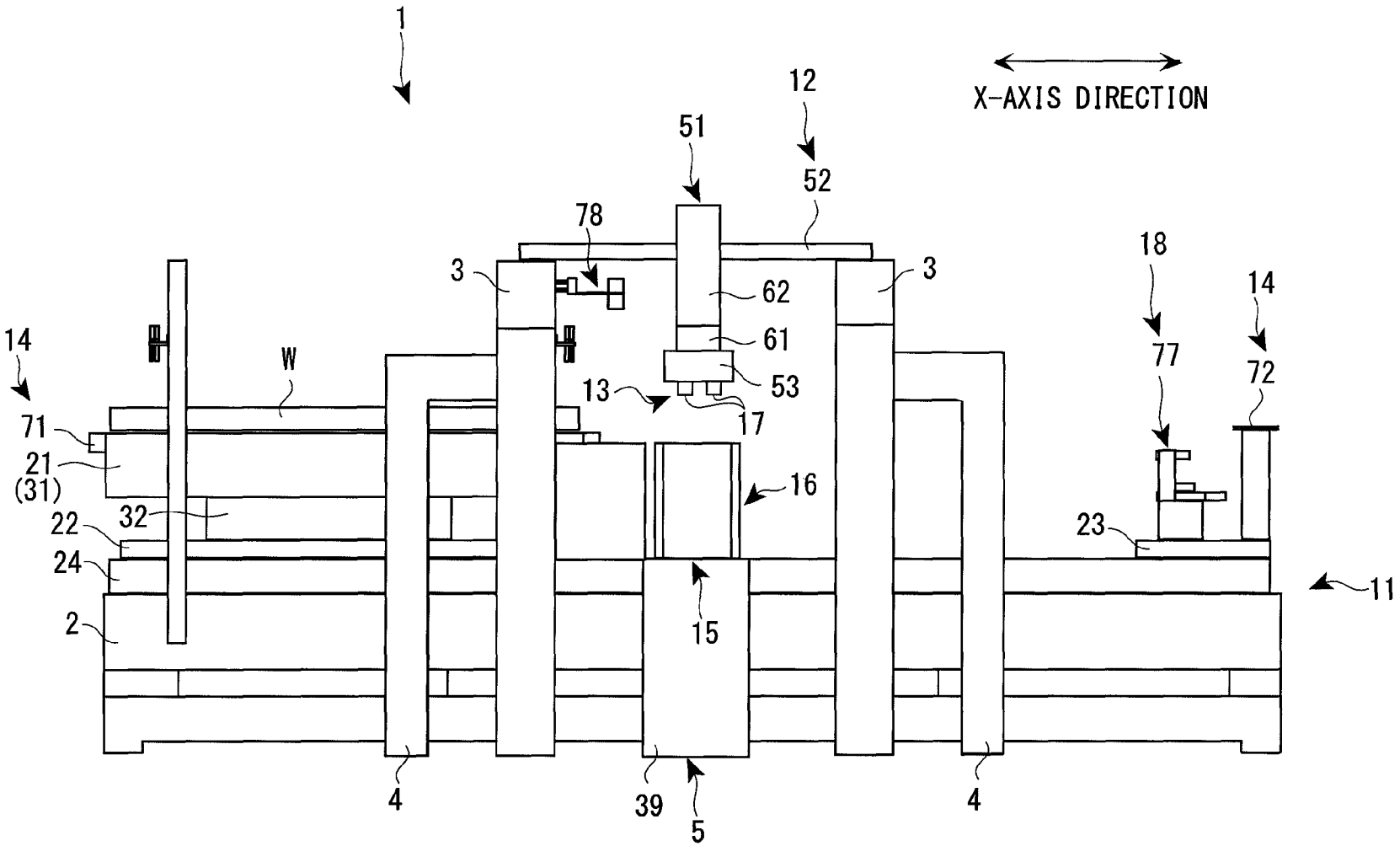
FIG. 3 is a side view of the liquid droplet ejection apparatus.

Referring to FIGS. 1, 2, and 3, a liquid droplet ejection apparatus 1 according to a first embodiment includes an X-axis table 11, a Y-axis table (moving table) 12, and ten carriage units 51. The X-axis table 11 is disposed on an X-axis support base 2 supported on a stone surface plate, extends in the X-axis direction that is a main scanning direction, and moves a workpiece W in the X-axis direction (main scanning direction). The Y-axis table 12 is disposed on a pair of (two) Y-axis support bases 3 arranged to stride across the X-axis table 11 using a plurality of poles 4 and extends in the Y-axis direction that is a sub-scanning direction. The ten carriage units 51 include a plurality of functional liquid droplet ejection heads 17 mounted thereon. The carriage units 51 are movably suspended over the Y-axis table 12.

Figure 10:
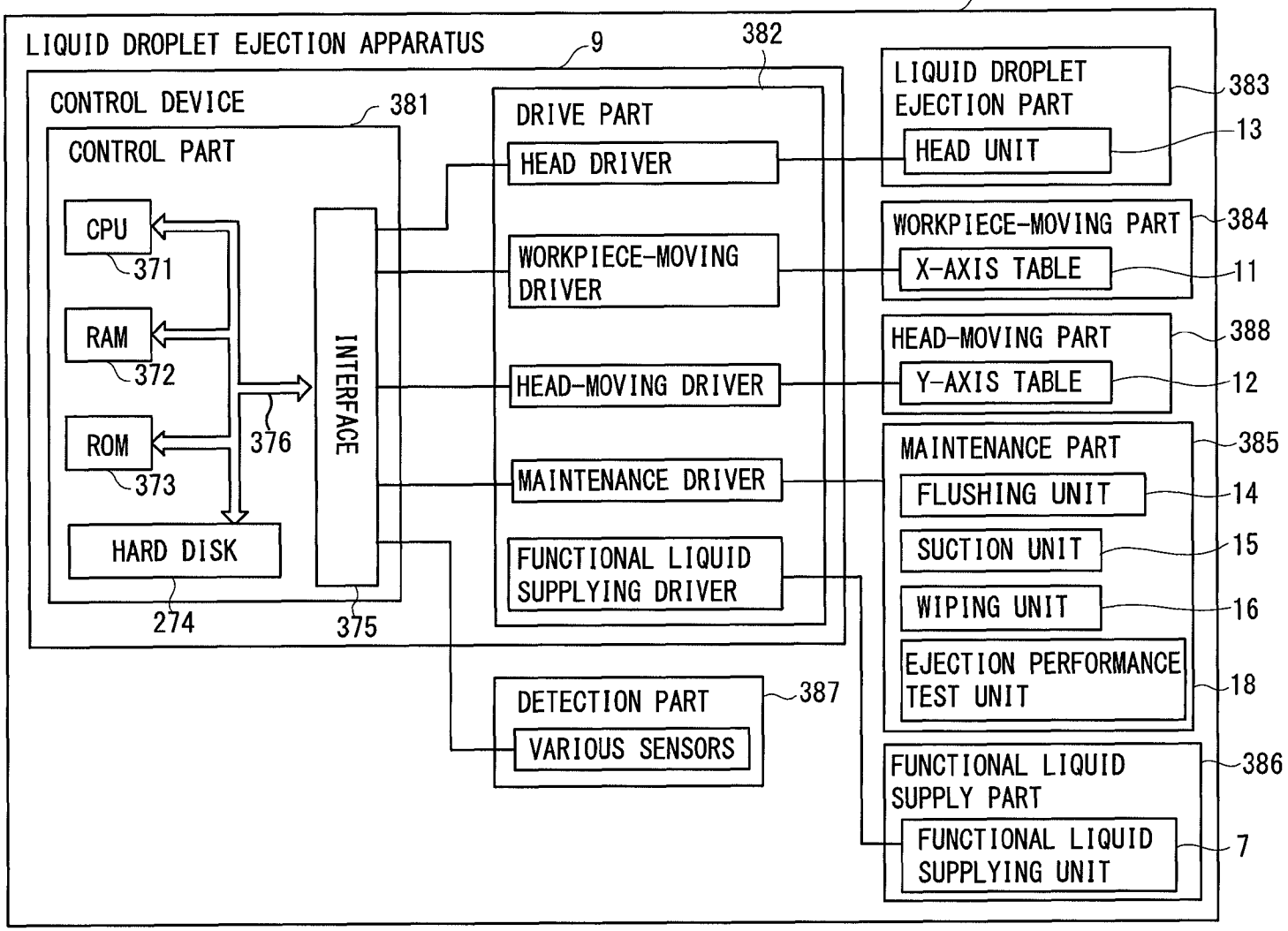
FIG. 10 is a block diagram showing a main control system (control device) of the liquid droplet ejection apparatus.

Further, the liquid droplet ejection apparatus 1 includes a chamber 6 which accommodates the above components in an atmosphere with humidity and temperature controlled and a functional liquid supplying unit 7 that has three sets of functional liquid supply devices 101 for supplying functional liquid to the functional liquid droplet ejection heads 17 inside the chamber 6 through the chamber 6 from the outside the chamber 6, and a control device 9 that collectively controls the above components (see FIG. 10). The functional liquid droplet ejection heads 17 are driven in synchronization with driving of the X-axis table 11 and the Y-axis table 12 to eject functional liquid droplets of three colors of R, G, and B supplied from the functional liquid supplying unit 7, so that a predetermined plotting pattern is plotted on the workpiece W.

Further, the liquid droplet ejection apparatus 1 includes a maintenance device 5 composed of a flushing unit 14, a plurality of (ten) suction units 15, a wiping unit 16, and an ejection performance test unit 18. These units are used for maintenance of the functional liquid droplet ejection heads 17, so that the functions of the functional liquid droplet ejection heads 17 can be maintained and recovered. Among the units constituting the maintenance device 5, the flushing unit 14 and the ejection performance test unit 18 are mounted on the X-axis table 11. Specifically, the ejection performance test unit 18 has a stage unit 77, which will be described later, mounted on the X-axis table 11, and a camera unit 78 supported on one of the Y-axis support bases 3. The plurality of (ten) suction units 15 and wiping unit 16 extend orthogonally to the X-axis table 11 and are disposed on a platform 39 placed where the carriage units 51 can be moved by using the Y-axis table 12.

The flushing unit 14 has a pair of pre-plotting flushing units 71 and a periodic flushing unit 72 both of which are subjected to ejection for maintenance (flushing) from the functional liquid droplet ejection heads 17 immediately before ejection from the functional liquid droplet ejection heads 17 or in a pause in plotting to replace the workpiece W with a new one. The (ten) suction units 15 forcibly suck the functional liquid from ejection nozzles 98 of the functional liquid droplet ejection heads 17 and cap the functional liquid droplet ejection heads 17. The wiping unit 16 has a wiping sheet 75 that wipes excess functional liquid off nozzle surfaces 97 of the functional liquid droplet ejection heads 17 after the suction. The ejection performance test unit 18 has the stage unit 77 and the camera unit 78, and inspects the ejection performance of the functional liquid droplet ejection heads 17 (whether ejection is performed and whether functional liquid droplets are ejected straight). Mounted on the stage unit 77 is a test sheet 83 that receives functional liquid droplets ejected from the functional liquid droplet ejection heads 17. The camera unit 78 is used to inspect the functional liquid droplets on the stage unit 77 by image recognition.

Components of the liquid droplet ejection apparatus 1 will now be described. As shown in FIGS. 2 and 3, the X-axis table 11 includes a set table 21, a first X-axis slider 22, a second X-axis slider 23, a pair of right and left X-axis linear motors (not shown), and a pair of (two) X-axis common supporting bases 24. The set table 21 is used to set a workpiece W in place. The first X-axis slider 22 slidably supports the set table 21 in the X-axis direction. The second X-axis slider 23 slidably supports the flushing unit 14 and the stage unit 77 in the X-axis direction. The right and left X-axis linear motors extend in the X-axis direction and move the set table 21 (workpiece W) in the X-axis direction through the first X-axis slider 22, while moving the flushing unit 14 and stage unit 77 in the X-axis direction through the second X-axis slider 23. The X-axis common supporting bases 24 are arranged side by side to the X-axis linear motors and guide the first X-axis slider 22 and the second X-axis slider 23.

The set table 21 has, for example, a suction table 31 that is used for sucking and setting the workpiece W in place and a θ table 32 that supports the suction table 31 to correct the position of the workpiece W set on the suction table 31 in a θ direction. The pre-plotting flushing units 71 are additionally provided to a pair of sides of the set table 21 that are parallel to the Y-axis direction.

The Y-axis table 12 includes ten bridge plates 52 having ten carriage units 51 suspended thereover, ten pairs of Y-axis sliders (not shown) supporting the ten bridge plates 52 at their both sides, and a pair of Y-axis linear motors (not shown) disposed on the pair of Y-axis support bases 3 to move the bridge plates 52 in the Y-axis direction through the ten pairs of Y-axis sliders. The Y-axis table 12 sub-scans the functional liquid droplet ejection heads 17 through the carriage units 51 during plotting, and controls the functional liquid droplet ejection heads 17 to face the maintenance device 5 (suction unit 15 and wiping unit 16).

The pair of Y-axis linear motors is (synchronously) driven to translate the Y-axis sliders synchronously in the Y-axis direction by using the pair of Y-axis support bases 3 as guides, whereby the bridge plates 52 move in the Y-axis direction along with the carriage units 51. In this case, each of the carriage units 51 may independently move by drive-controlling the Y-axis linear motors, or the ten carriage units 51 may integrally move.

Cable supporting members 81 are disposed on both sides of the Y-axis table 12 to be parallel to the Y-axis table 12. Each of the cable supporting members 81 has one end secured to the Y-axis support base 3 and the other end secured to one of the bridge plates 52. The cable supporting members 81 accommodate, for example, cables, air tubes, and functional liquid channels for the carriage units 51.

Figure 4:
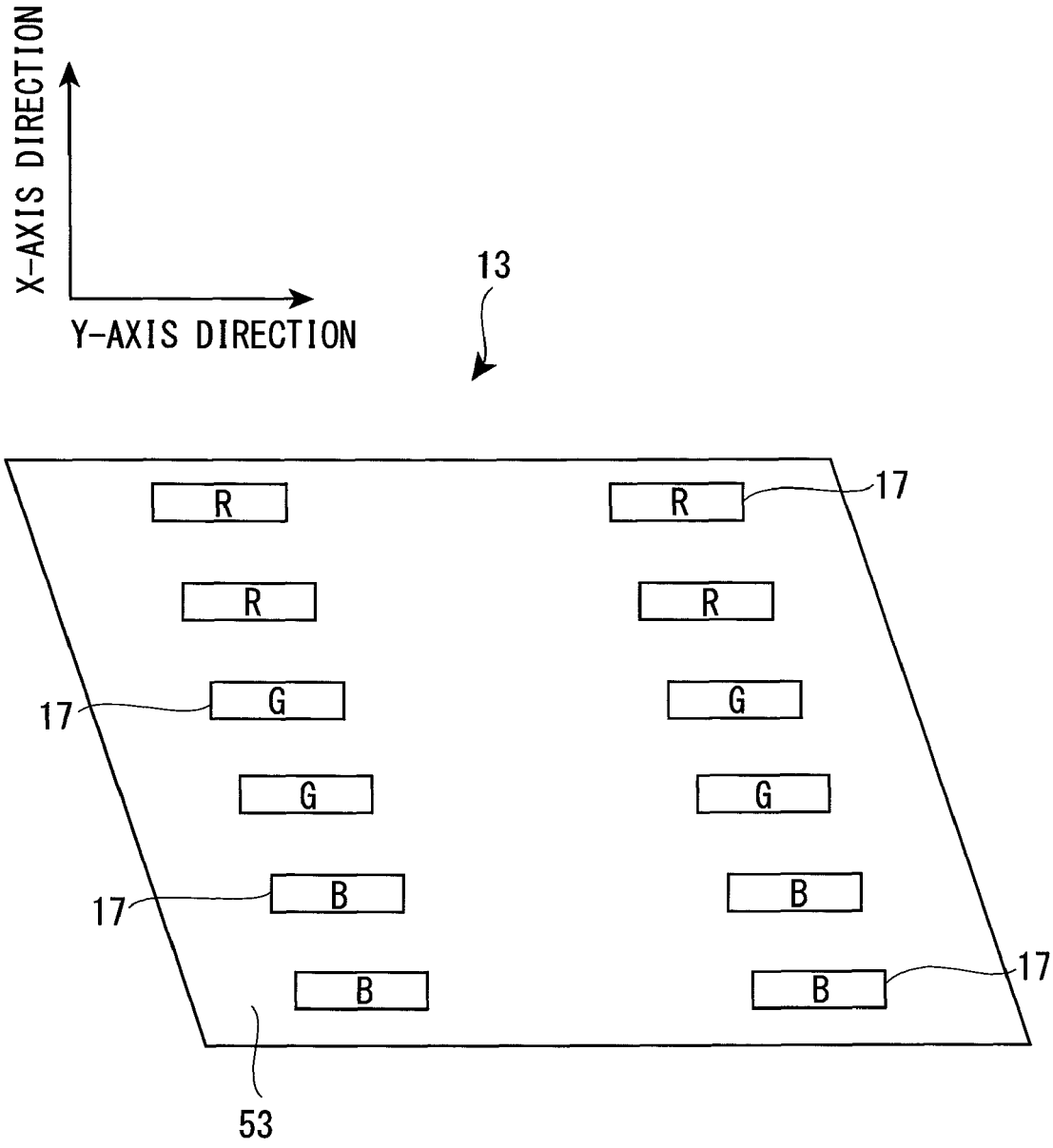
FIG. 4 is a plan view of a head unit.

Each of the carriage units 51 includes a head unit 13 having twelve functional liquid droplet ejection heads 17, and a head plate 53 that supports the twelve functional liquid droplet ejection heads 17 divided into two groups each of which is composed of six liquid droplet ejection heads (see FIG. 4). Further, the carriage units 51 include a θ rotation mechanism 61 that supports the head unit 13 so that the head unit 13 can be subjected to θ correction (θ rotation), and a hanging member 62 that supports the head unit 13 on the Y-axis table 12 (bridge plates 52) by using the θ rotation mechanism 61. In addition, each of the carriage units 51 has a sub-tank 121 on its upper part (specifically, on the bridge plates 52 as shown in FIG. 1) to supply the functional liquid droplet ejection heads 17 with functional liquid using natural water heads from the sub-tank 121 and through pressure reducing valves (not shown).

As described above, the twelve functional liquid droplet ejection heads 17 are supported on the head plate 53 divided into two groups each of which is composed of six functional liquid droplet ejection heads 17. The six functional liquid droplet ejection heads 17 in each group are composed of two functional liquid droplet ejection heads 17 for red, two functional liquid droplet ejection heads 17 for green, and two functional liquid droplet ejection heads 17 for blue. Lines for partial plotting are so configured that the two functional liquid droplet ejection heads 17 for each color are disposed adjacent to one another, and a number of ejection nozzles 98 used for actual plotting (effective nozzles, which will be described later) are sequentially arranged. Each line for partial plotting by color in both groups is mutually arranged spaced apart in the Y-axis direction by a distance corresponding to two lines for partial plotting. Therefore, a desired color pattern is plotted on the workpiece W with three main scans and two sub-scans therebetween.

Figure 5:
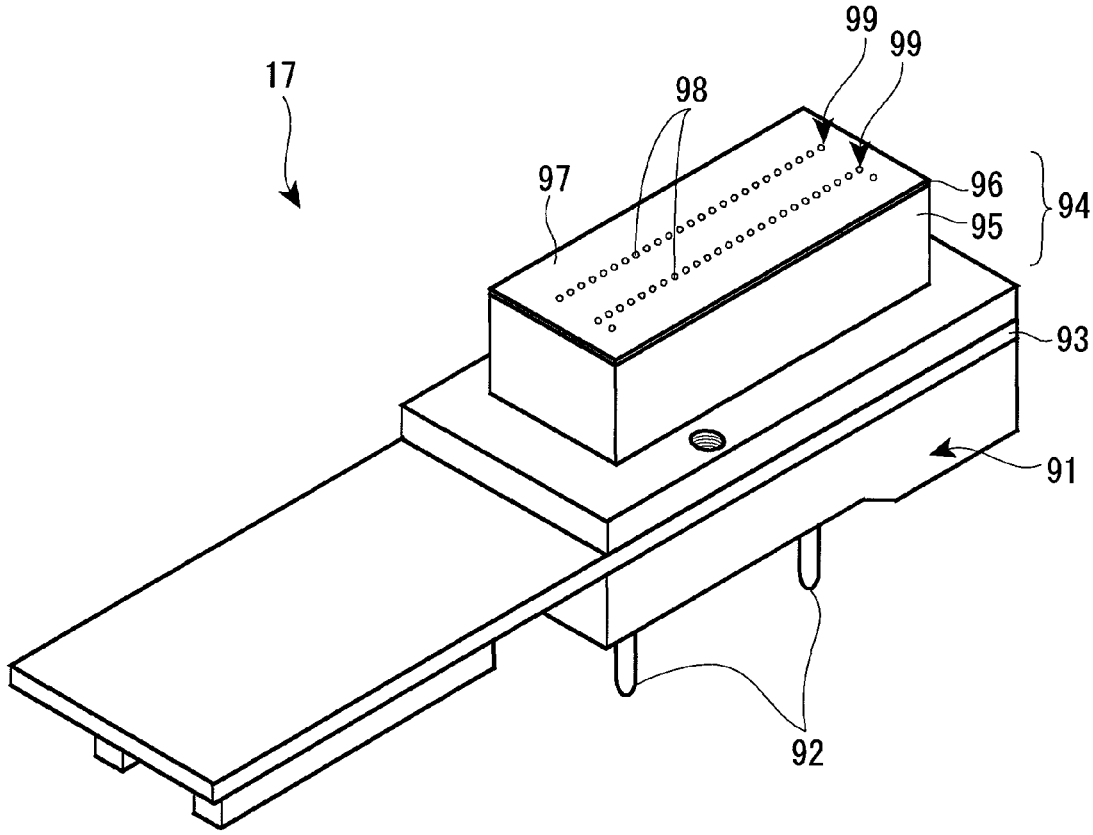
FIG. 5 is a perspective view of the functional liquid droplet ejection head.

As shown in FIG. 5, each of the functional liquid droplet ejection heads 17 is a so-called twin-type head, and includes a functional liquid introduction part 91 having two connecting needles 92, two head boards 93 coupled to the functional liquid introduction part 91, and a head body 94 coupled downward to the functional liquid introduction part 91 and formed with an in-head channel filled with the functional liquid therein. The connecting needles 92 are connected to the functional liquid supplying unit 7 (functional liquid supply device 101) to supply the functional liquid introduction part 91 with the functional liquid. The head body 94 includes a cavity 95 (piezoelectric element) and a nozzle plate 96 having a nozzle surface 97 with a number of ejection nozzles 98 opened therethrough. When the functional liquid droplet ejection heads 17 are driven for ejection, (by means of a voltage applied to the piezoelectric element) functional liquid droplets are ejected from the ejection nozzles 98 by a pumping action of the cavity 95.

The nozzle surface 97 is provided with two split nozzle rows 99, 99 with a number of ejection nozzles 98 that are arranged in parallel to each other. The two split nozzle rows 99 are arranged so as to be displaced by a half nozzle pitch. A plurality (ten each) of ejection nozzles 98 at opposite ends of each nozzle row 99 out of a number of (180) the ejection nozzles 98 is not used for actual plotting. In actual plotting, one hundred and sixty ejection nozzles 98 in the center portion are used as the effective nozzles.

The chamber 6 keeps the temperature and humidity therein constant. Specifically, the liquid droplet ejection apparatus 1 performs plotting on the workpiece W under an atmosphere of fixed temperature and humidity. A tank cabinet 84 is disposed at a part of a side wall of the chamber 6 to accommodate a tank unit 122 continuing to the sub-tank 121. It is preferable that an atmosphere in the chamber 6 be filled with inert gas (nitrogen gas) when organic electroluminescence devices and the like are manufactured.

As shown in FIGS. 1 and 2, a maintenance area 213 is an area with the wiping unit 16 and ten (a plurality of) suction units 15. When the operation of the liquid droplet ejection apparatus 1 is stopped, ten carriage units 51 are moved to the position of the ten suction units 15 by means of the Y-axis table 12 to cap all the functional liquid droplet ejection heads 17, so-called capping. On the other hand, when the operation is started, all the functional liquid droplet ejection heads 17 are sucked and subsequently wiped in units of the carriage units 51 facing the wiping unit 16, and then the ten carriage units 51 are sequentially moved to a plotting area 214 on the X-axis table 11.

Further, if the ejection performance test unit 18 detects an ejection failure in the third carriage unit 51 from the maintenance area 213 side in operation, for example, three, the first to third, carriage units therefrom are moved onto three, the first to third, suction units 15 from the plotting area 214 side. Then, while one relevant carriage unit 51 is subjected to the suction process by a corresponding suction unit 15, the other two carriage units 51 are subjected to the ejection for maintenance (flushing) from the respective functional liquid droplet ejection heads 17 to the suction units 15. In this manner, the ten carriage units 51 are individually controlled, and accordingly the ten suction units 15 are also individually controlled. Thus, the ten suction units 15 constitute the suction system of the apparatus according to the present embodiment.

The suction units 15 will now be described with reference to FIGS. 6 and 8. Each suction unit 15 includes a cap unit 203 having twelve head caps 201 corresponding to the twelve functional liquid droplet ejection heads 17 mounted on a cap plate 202, a suction mechanism 204 coupled to the cap unit, a lifting/lowering mechanism 206 for lifting and lowering the cap unit 203, and an inclination adjustment mechanism 207 for adjusting a pitching direction and a yawing direction of the cap unit 203, as will be described later.

Figure 6:
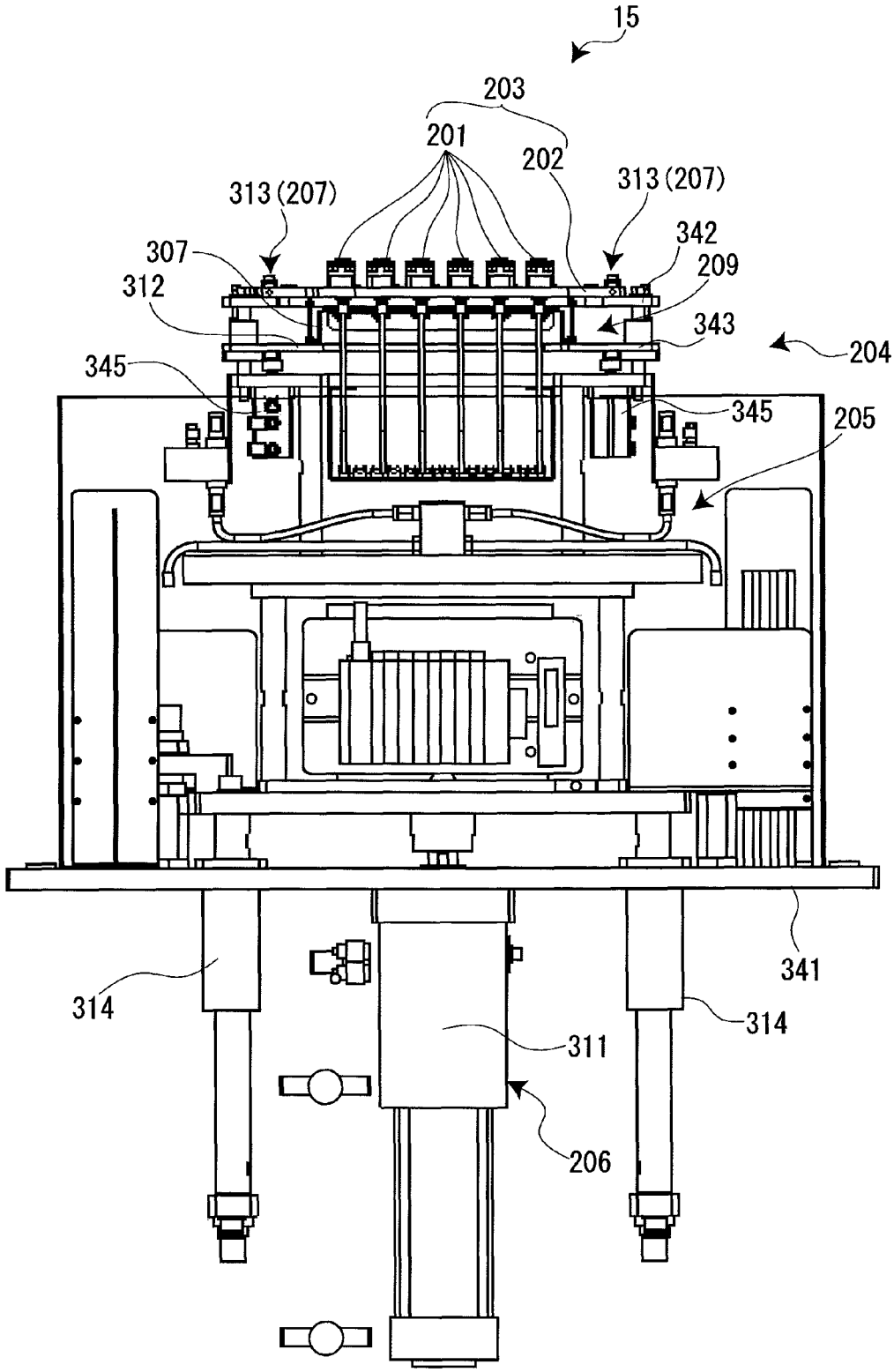
FIG. 6 is a side view of a suction device.

As shown in FIG. 6, the lifting/lowering mechanism 206 includes a lifting/lowering cylinder 311 for lifting and lowering the head caps 201 using a support 205, a pair of linear guides 314 for guiding lifting/lowering operations of the lifting/lowering cylinder 311, and a base 341 supporting these components. The lifting/lowering cylinder 311 lifts and lowers the cap unit 203 among the following three levels: a close position for suction, a spaced position for flushing, and an exchange position for exchanging the head units 13 or exchanging consumable supplies for the cap unit 203 (maintenance).

The support 205 has a body frame 343, a support frame 342 that is mounted on the upper end portion of the body frame 343 and supports the cap unit 203, and a release frame 312 that is horizontally disposed directly under the support frame 342. The release frame 312 is provided with twelve operating pawls 307 that collectively release twelve air release valves 208, which will be described later. The air release valves 208 are released (opened) via a pair of air cylinders 345 connected to the release frame 312.

Figure 7:
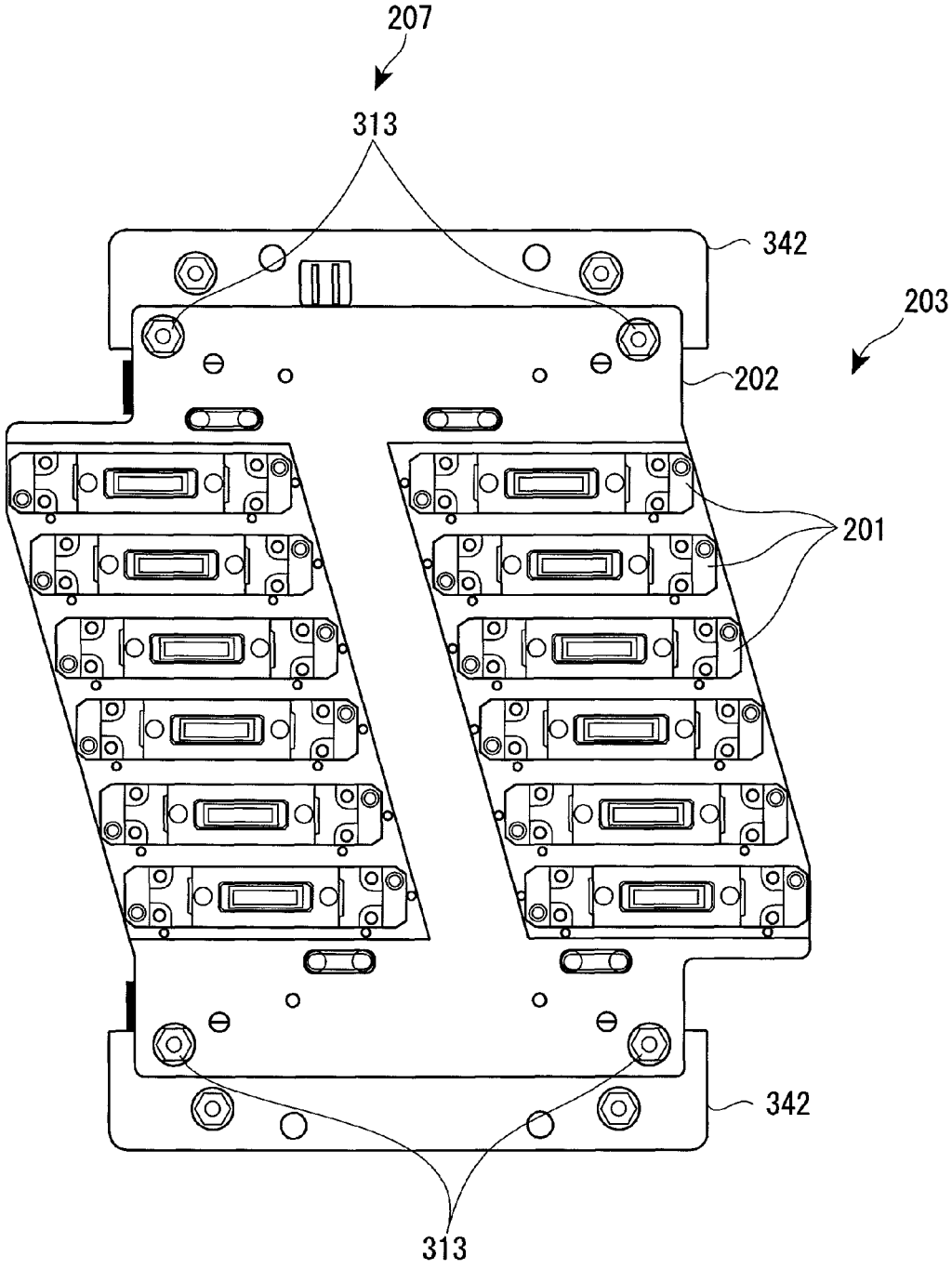
FIG. 7 is a plan view of the suction device.

As shown in FIGS. 6 and 7, the inclination adjustment mechanism 207 is composed of four height adjustment mechanisms 313 provided at the four corners of the cap plate 202. Each of the height adjustment mechanisms 313 has an adjusting screw abutted against the support frame 342 and a fixing screw that threadably engages the cap plate 202 to the support frame 342 through the axis of the adjusting screw. In other words, a series of inclination adjustment can be made by threadably fixing the four fixing screws to the support frame 342, after the inclination in the pitching direction and the yawing direction of the head cap 201 is adjusted by forwardly or reversely rotating the four adjusting screws.

Figure 8:
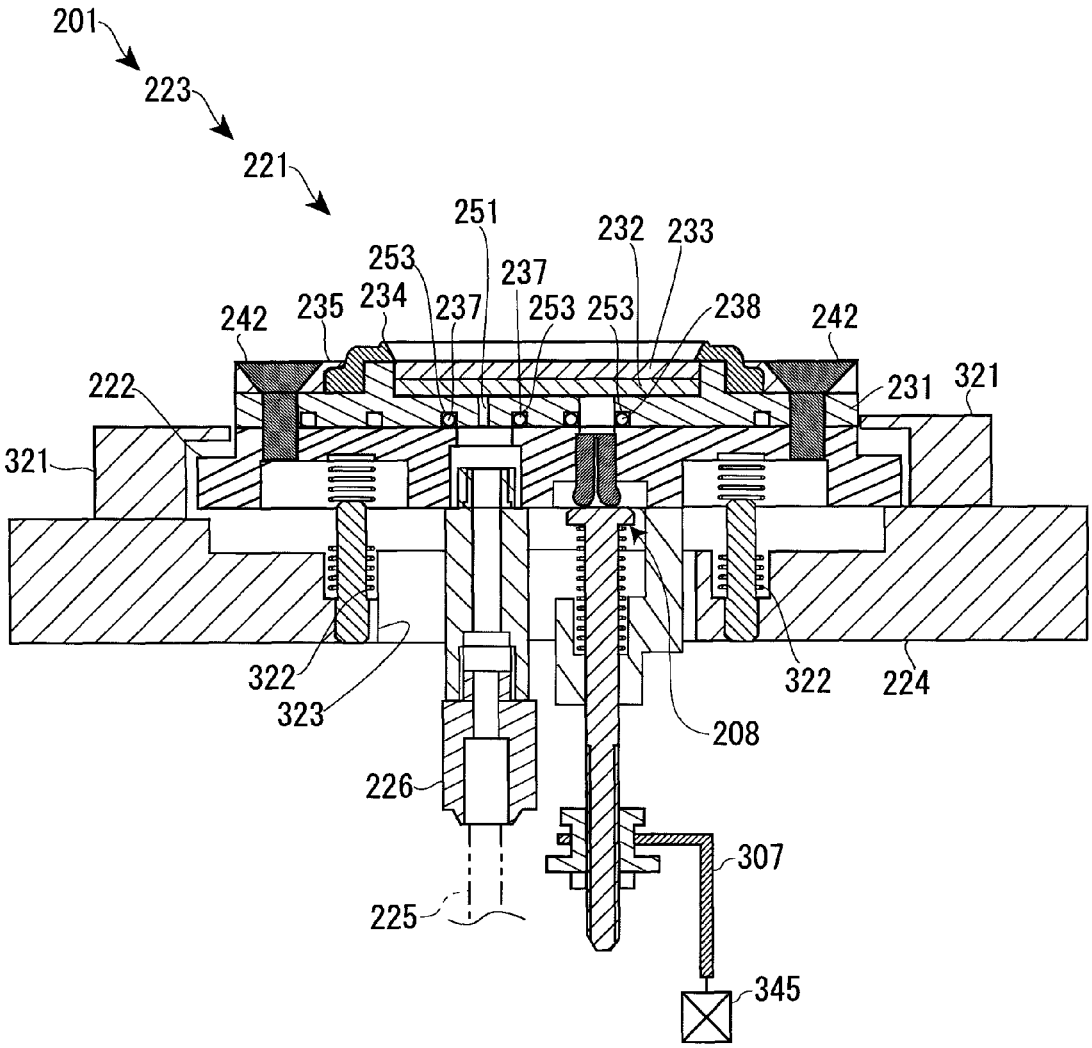
FIG. 8 is a sectional view of a head cap.

As shown in FIG. 8, the head cap 201 includes a cap body 223 having a cap assembly 221 and an assembly base 222, and a cap holder 224 retaining the cap assembly 221. The cap assembly 221 includes an absorbent holder 231, a functional liquid absorbent 232, a functional liquid absorbent keeper 233, a sealing member 234, and a frame-shaped keeping member 235, all of which are united by a pair of fastening screws (not shown). A fluid-tight sealing member 237 and an airtight sealing member 238 (both are O-rings) are disposed between the cap assembly 221 and the assembly base 222 in such a way that both members 237 and 238 are fitted to a pair of annular grooves 253 formed on the absorbent holder 231. Further, the cap body 223 is formed as a unit using fitting screws 242 threadably fixed to the assembly base 222 through the cap assembly 221 from the frame-shaped keeping member 235.

The cap holder 224 includes a cap holder body 320, a pair of retention blocks 321 that retains the cap body 223 together with the cap holder body 320, and a pair of contact springs 322 that biases the cap body 223 upwardly using the cap holder body 320 as a receiver. An opening 323 to which a union junction 226 and the air release valve 208 are inserted is formed in the center portion of the cap holder body 320.

The functional liquid channel 251 coupled to the groove bottom of the absorbent holder 231 is connected to a suction channel 225, which will be described later, using the union junction 226. The air release valve 208 is connected to the operating pawl 307 and opened when the pair of air cylinders 345 lowers the operating pawl 307. The functional liquid in the head cap 201 can be sucked by opening the air release valve 208 immediately before the end of the suction operation.

As described above, the cap unit 203 is composed of twelve head caps 201 held on the cap plate 202 and divided into three color groups (R, G, and B) each having four caps corresponding to the twelve functional liquid droplet ejection heads 17 divided into three color head units 13 each having four heads. Specifically, the twelve head caps 201 mounted on the cap unit 203 have the same arrangement as the functional liquid droplet ejection heads 17 mounted on the head units 13 and simultaneously contact/move to/away from the twelve functional liquid droplet ejection heads 17 (see FIGS. 4 and 7).

Next, the suction mechanism 204 will be described with reference to FIG. 9. The suction mechanism 204 is composed of a suction mechanism for red 204R, a suction mechanism for green 204G, and a suction mechanism for blue 204B corresponding to the three colors (R, G, and B) of the functional liquid droplet ejection heads 17. Here the suction mechanism for red 204R will be described by way of example since the configuration and function of the suction mechanisms 204 R, 204G, and 204B of the respective colors are the same. The viscosities of the functional liquids used in the embodiment as well as their hues differ from one another, therefore the function of the plurality of functional liquid droplet ejection heads to which functional liquids having different colors are introduced can be appropriately maintained and recovered while the consumption of waste functional liquid is suppressed by composing the suction mechanisms by color.

Figure 9:
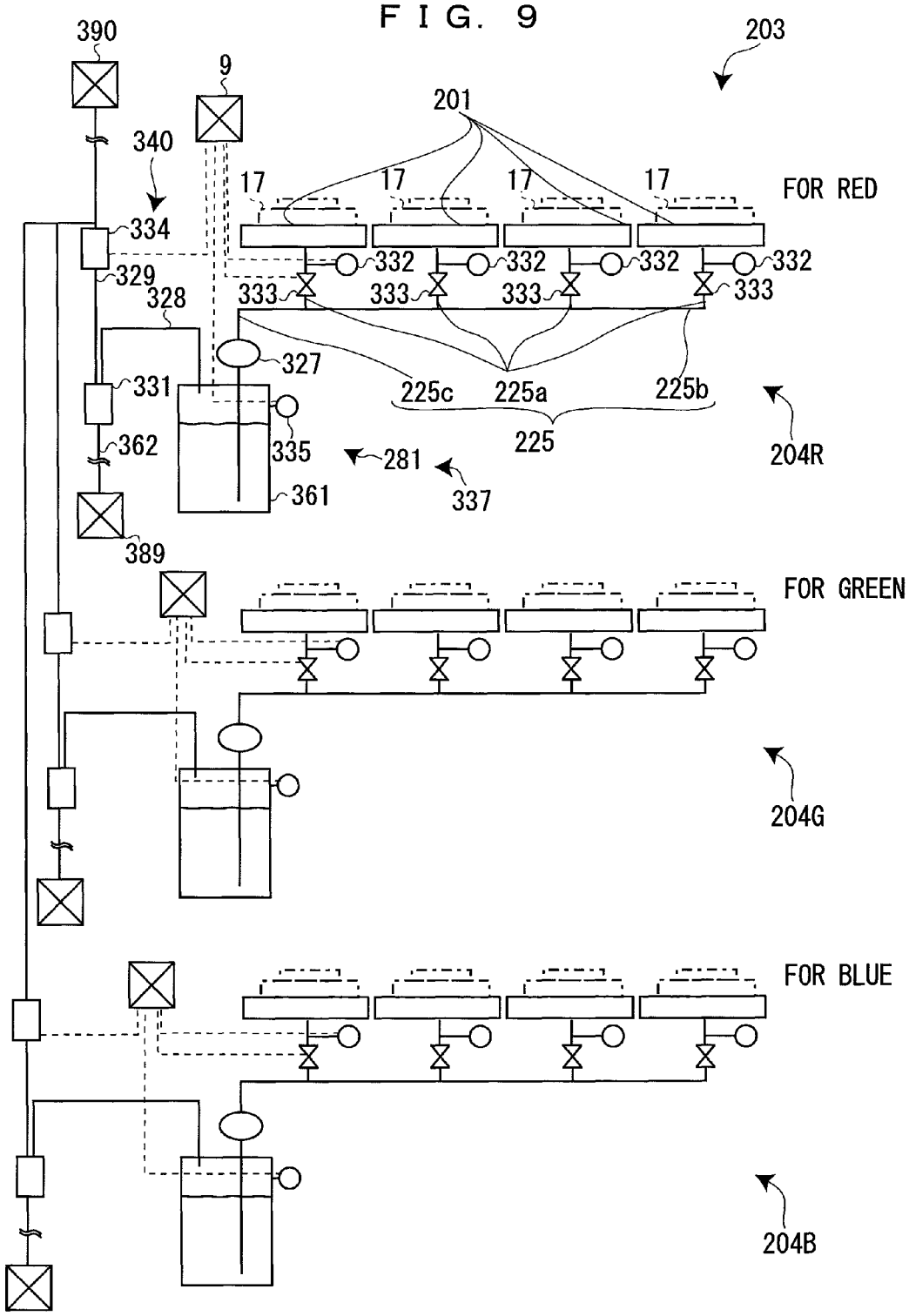
FIG. 9 is a diagram of a suction mechanism system.

As shown in FIG. 9, the suction mechanism for red 204R has a suction unit 337 that sucks the functional liquid via the plurality of (four) head caps for red 201 and the suction channel 225 that connects the plurality of head caps 201 with the suction unit 337.

The suction channel 225 includes a plurality of (four) individual channels 225*a* having their upstream sides connected to the respective head caps 201, a junction part 225*b* (manifold) that combines the respective individual channels 225*a* all together, and a junction channel 225*c* connected to the downstream sides of the individual channels 225*a* via the junction part 225*b*. Each of the individual channels 225*a* is provided with an open/close valve 333 (channel opening/closing unit) and an individual pressure sensor 332. The open/close valve 333 and the individual pressure sensor are connected to the control device 9 (see FIG. 10).

The junction channel 225*c* is disposed between the junction part 225*b* and a waste liquid tank 281 that is described later, and the downstream end of the junction channel 225*c* is deeply inserted into the vicinity of the bottom of the waste liquid tank 281. Specifically, the (waste) functional liquid is sucked into the waste liquid tank 281 from the individual channels 255*a* connected to the head caps 201 via the union junction 226 through the junction part 225*b* and the junction channel 225*c*. Further, the downstream side of the junction channel 225*c* is provided with a flowmeter (a flow rate detection unit that specifically detects current velocity) 327 that measures the flow rate of the (waste) functional liquid sucked into the waste liquid tank 281.

The suction unit 337 includes the flowmeter 327, the waste liquid tank 281 composed of a so-called sealed tank, an ejector 331 having its primary side connected to a compressed air supplying system 390, a suction conduit 328 having its upstream end connected to an upper space of the waste liquid tank 281 and its downstream end connected to the secondary side of the ejector 331, a regulator (pressure adjustment unit) 334 disposed between the ejector 331 and the compressed air supplying system 390 to adjust the pressure of compressed air supplied to the ejector 331, a pressure sensor (pressure detection unit) 335 that detects inner pressure of the waste liquid tank 281, and the control device 9 that controls the regulator 334.

The ejector 331 connects its secondary side to the waste liquid tank 281 through the suction conduit 328 and its primary side to the regulator 334 through a compressed air channel 329. Specifically, negative pressure is generated at the secondary side of the ejector 331 by introducing compressed air to the primary side of the ejector 331 via the compressed air channel 329, whereby the functional liquid is sucked to the waste liquid tank 281 via the head caps 201 closely contacted with the functional liquid droplet ejection heads 17. The air passing through the ejector 331 is sent off to an exhaust system 389.

The regulator 334 is an electro-pneumatic regulator. The control device 9 causes the regulator 334 to appropriately depressurize the compressed air supplied from the compressed air supplying system 390 to supply the ejector 331 with the compressed air. Specifically, the regulator 334 adjusts the pressure of the compressed air, thereby adjusting the pressure of the secondary side of the ejector 331 (suction pressure: negative pressure).

Referring next to FIG. 10, the main control system of the liquid droplet ejection apparatus 1 will be described. The liquid droplet ejection apparatus 1 includes a liquid droplet ejection part 383 having a head unit 13 (functional liquid droplet ejection heads 17), a workpiece-moving part 384 that has the X-axis table 11 and moves a workpiece W in the X-axis direction, a head-moving part 388 that has the Y-axis table 12 and moves the head unit 13 in the Y-axis direction, a maintenance part 385 that has each of the maintenance units, a functional liquid supply part 386 that has the functional liquid supplying unit 7 and supplies the functional liquid droplet ejection heads 17 with functional liquid, a detection part 387 that has various sensors and performs various detection operations, a drive part 382 that has various drivers to drive and control each part, and a control part (control unit) 381 that is connected to each part and controls the whole liquid droplet ejection apparatus 1. The control device 9 is composed of the drive part 382 and the control part 381.

The control part 381 includes an interface 375 for connecting respective units, a RAM 372 that has a storage area capable of temporarily storing information and is used as a working area for the control, a ROM 373 that has various storage areas and stores control programs and data, a hard disk 374 that stores plotting data to plot a predetermined plotting pattern on the workpiece W and various data from the units, as well as programs to process various data and the like, a CPU 371 that processes various data according to, for example, the programs stored in the ROM 203 and the hard disk 204, and a bus 376 that interconnects these components.

The control part 381 inputs various data from the units via the interface 201, and also causes the CPU 371 to process the data according to the programs stored in the hard disk 374 (or sequentially read from a CD-ROM drive and the like) to output the result to respective units via the drive part 382 (various drivers). This allows the entire apparatus to be controlled to perform various processes of the liquid droplet ejection apparatus 1.

Next, the control method of the suction units 15 by the control device 9 will be described. The suction unit 15 in this embodiment includes a suction feature that sucks the functional liquid from the functional liquid droplet ejection heads 17, a liquid-receiving feature that receives the ejection for maintenance from the functional liquid droplet ejection heads 17, and a capping feature that caps the functional liquid droplet ejection heads 17. The capping feature functions to prevent the functional liquid at the ejection nozzle 98 from being dried out during non-operation of the apparatus and drive the lifting/lowering mechanism 206 to bring the head caps 201 into contact with (close position) the functional liquid droplet ejection heads 17 (head unit 13) facing to a top portion of the head caps 201 (cap unit 203).

The liquid-receiving feature functions to receive the ejection for maintenance to maintain the function conducted by the functional liquid droplet ejection heads 17 in standby, e.g., waiting for the wiping process, and suck the functional liquid accumulated in the head caps 201 by driving the suction mechanism 204 while moving the head caps 201 (cap unit 203) to a spaced position by the lifting/lowering mechanism 206 to receive the ejection for maintenance by the functional liquid droplet ejection heads 17. In this suction process, driving of the suction mechanism 204 starts immediately before the functional liquid droplet ejection heads 17 is driven to eject, such that mist of the functional liquid resulting from the ejection for maintenance is similarly sucked.

The suction feature functions to suck thickened functional liquid from the functional liquid droplet ejection heads 17 to recover the function of the functional liquid droplet ejection heads 17 when the apparatus starts operating or the ejection performance test unit 18 detects an ejection failure, and move the head caps 201 (cap unit 203) to the close position by the lifting/lowering mechanism 206 before driving the suction mechanism 204 to suck the functional liquid from all the ejection nozzles 98 of the functional liquid droplet ejection heads 17 via the head caps 201.

The suction units 15 are provided with the suction mechanisms for red 204R, green 204G, and blue 204B by color, as described above. Since the three-color functional liquids mutually differ in viscosity, the respective regulators 334 are individually controlled based on a control table obtained beforehand in experiments, to set optimal suction pressures for the suction mechanisms for red 204R, green 204G, and blue 204B. The individual pressure sensor 332, the pressure sensor 335, and the flowmeter 327 monitor whether the respective suction operations are performed in an optimal manner.

The respective regulators 334 are individually controlled to conduct the suction by the liquid-receiving feature (suction with a weak suction force) at an optimal suction pressure based on the control table. Similarly, the control (process control) is so conducted that the suction is conducted by strong suction pressure in the initial suction stage and by weak suction pressure in the final suction stage to exclude air bubbles in the channels when the functional liquid is initially charged to the functional liquid droplet ejection heads 17.

On the other hand, it is also possible to conduct the suction operation of the functional liquid (suction feature) as follows. When some of the four functional liquid droplet ejection heads 17 for respective colors require the functional recovery and others do not as a result of the test by the ejection performance test unit 18, the open/close valves 333 for the functional liquid droplet ejection heads 17 that require the functional recovery are opened and the open/close valves 333 for the functional liquid droplet ejection heads 17 that do not require the functional recovery are closed. In this case, even if the number of the functional liquid droplet ejection heads 17 requiring suction is changed, the following control operations are conducted such that the suction pressure is equal in the respective functional liquid droplet ejection heads 17 (the same detection values for the respective individual pressure sensors 332).

In this case, the suction operation is conducted by applying an optimal suction pressure that is previously calculated according to the number of the open/close valves 333 to be opened. It is preferable that the control table for the optimal suction pressure be obtained based on the viscosity of the relevant functional liquid in addition to the number of the open/close valves 333 opened.

Since the head caps 201 are provided with corresponding open/close valves 333 as described above, only the open/close valves 333 corresponding to the functional liquid droplet ejection heads 17 requiring the suction operation are opened. In this case as well, the number of the open/close valves 333 opened is calculated to obtain from the control table the suction pressure corresponding to the calculated number. Then, the control device 9 controls the regulator 334 according to the control table, based on the number of the open/close valves 333 opened. This allows the suction pressure (negative pressure) detected by the individual pressure sensor 332 to be constant even if the number of open/close valves 333 opened is changed.

Further, the regulator 334 is so controlled as to set the suction pressure detected by the pressure sensor 335 disposed in the waste liquid tank 281 to be a predetermined pressure (based on the control table), in addition to the control of the pressure according to the number of these open/close valves 333. In this case as well, the suction operation is conducted while the regulator 334 is controlled such that the suction pressure in the waste liquid tank 281 is set to be suction pressure corresponding to the number of the open/close valves 333 opened (feedback control). This allows further accurate pressure control.

While the above example of the suction operation employs the method in which the regulator 334 is controlled based on the detection value of the pressure sensor 335, the following method may be used instead.

This alternative control method uses the flowmeter 327 disposed at the downstream side of the junction channel 225*c* in place of the pressure sensor 335. This method previously calculates the suction pressure corresponding to an optimal suction flow rate flowing into the waste liquid tank 281 (using the control table). First, the number of the open/close valves 333 to be opened is calculated which correspond to the functional liquid droplet ejection heads 17 requiring the suction. Subsequently, the control unit 340 controls the regulator 334 such that the flow rate of the functional liquid flowing into the waste liquid tank 281 is set to be a suction flow rate corresponding to the number of the open/close valves 333 opened (feedback control). Similar to the case of using the individual pressure sensor 332, it is possible to control to set the suction pressure to be constant in any of the head caps 201. It is further preferable that the control table be obtained based on the viscosity of the functional liquid in this case as well.

In this configuration, the suction of the respective functional liquid droplet ejection heads 17 can be conducted at an appropriate pressure since the suction pressure of the functional liquid droplet ejection heads 17 can be individually adjusted corresponding to functional liquids having different viscosities by color. The suction of the functional liquid can be conducted by applying a constant pressure at anytime since the suction pressure can be adjusted corresponding to the number of the functional liquid droplet ejection heads 17 requiring the suction in the suction mechanisms 204 for respective colors. Accordingly, the function of the respective functional liquid droplet ejection heads 17 can be appropriately recovered while the consumption of the functional liquid is suppressed.

As for the above-described initial charging process, each of the individual channels 225*a* may be provided with a liquid detection sensor and it is presumed that the initial charge of a relevant functional liquid droplet ejection head 17 has finished when the liquid detection sensor detects the functional liquid. Then the open/close valve 333 for the corresponding head cap 201 is controlled to be opened, whereby the consumption of the waste functional liquid can be suppressed. In such a case, the above-described control operation can be conducted based on the number of the open/close valves 333 opened.

While the liquid droplet ejection apparatus 1 having ten carriage units 51 is used in the above-described embodiment, the numbers of the carriage units 51 and the functional liquid droplet ejection heads 17 mounted on each of the carriage units 51 are optional.

Figure 11:
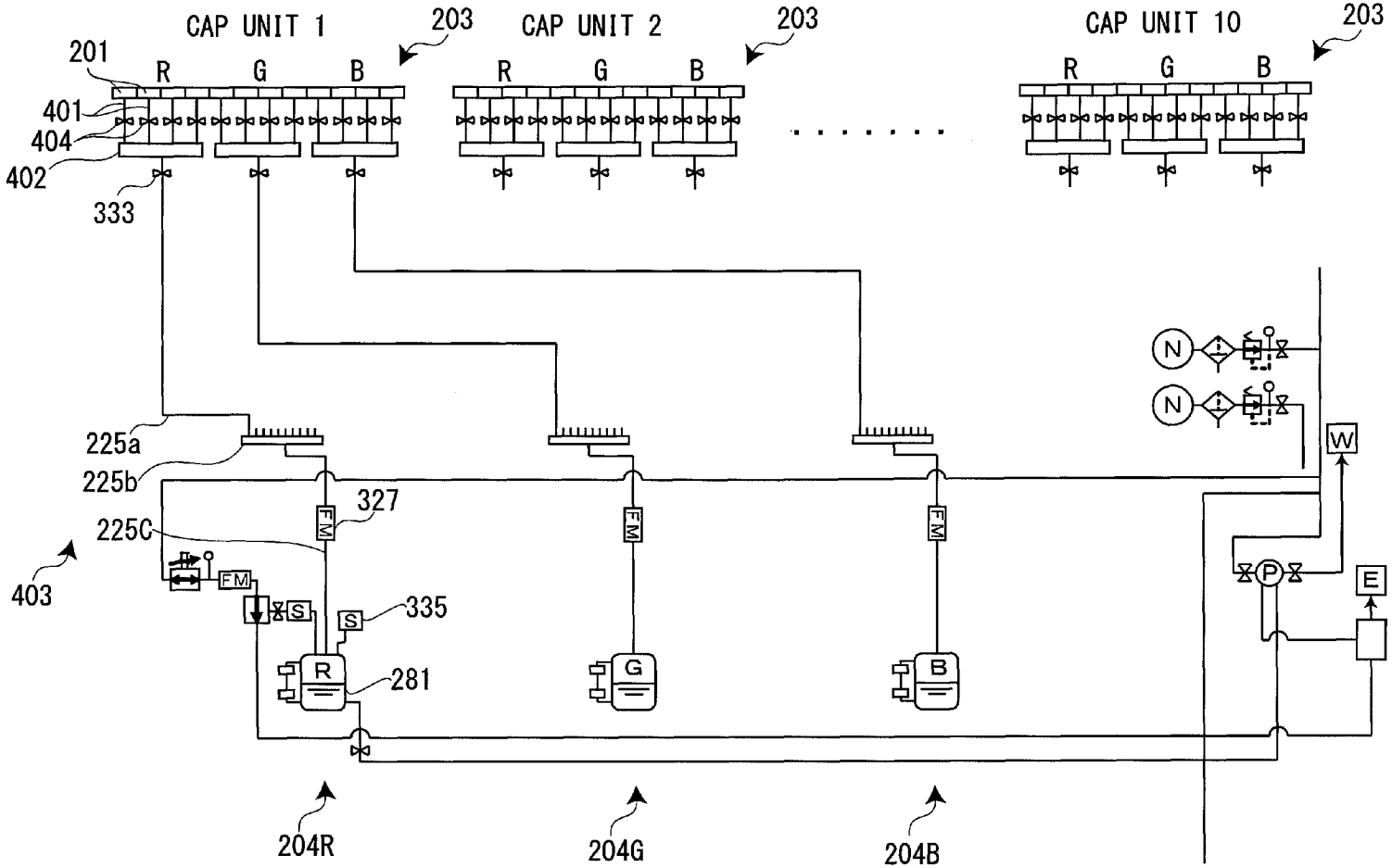
FIG. 11 is a diagram of the suction mechanism system according to the second embodiment.

Referring next to FIG. 11, a second embodiment relating to the suction unit 15 will now be described. In this embodiment, the suction unit 15 includes ten cap units 203 corresponding to ten carriage units 51, ten supports 205, and ten lifting/lowering mechanisms 206 similarly to the first embodiment, and three sets of suction mechanisms 204 which correspond to functional liquid droplet ejection heads 17 with three colors. Specifically, four head caps 201 each for the same color are connected to corresponding suction mechanisms 204 in each of the ten cap units 203. In other words, each of the cap units 203 is provided with the suction mechanisms for red 204R, green 204G, and blue 204B in the first embodiment, whereas the ten cap units 203 are provided with the suction mechanisms for red 204R, green 204G, and blue 204B in the second embodiment.

In this case, a suction channel 225 of the suction mechanism for red 204R includes forty cap-side channels 401 connected to each of four head caps for red 201 (a total of forty caps) in the ten cap units 203, ten cap-side junction parts (manifolds) 402 that combine the four cap-side channels 401 corresponding to a common cap unit 203, and ten sets of tank-side channels 403 having their upstream sides connected to the respective ten cap-side junction parts 402 and their downstream sides connected to the waste liquid tank for red 281, for example. Further, each of the cap-side channels 401 is provided with an individual valve 404 to individually open/close the connection to the head cap 201.

Each of the tank-side channels 403 includes ten individual channels 225*a* that connect their upstream sides to the ten cap-side junction parts 402, a tank-side junction part (manifold) 225*b* that combines the ten individual channels 225*a* all together, and a junction channel 225*c* that connects its upstream side to the tank-side junction part 225*b* and its downstream side to the waste liquid tank 281. Specifically, a single individual channel 225*a* is connected to each of the cap-side junction parts 402 of each color and provided with an open/close valve 333 in the vicinity of the cap-side junction part (branch) of this individual channel 225*a*.

Since the suction unit 337 composed of the waste liquid tanks 281 for each color, the ejector 331 and the like is similar to that of the first embodiment; therefore the description thereof will be omitted.

Also in this embodiment, when some functional liquid droplet ejection heads conduct the suction process in the units of the carriage units (head units 13) 51 and others do not, similar control operation to that of the first embodiment is conducted according to the number of the open/close valves 333 to be opened (see paragraphs [0076] through [0081]). A concurrent process of the suction processes for suction and flushing may be conducted by providing two sets of suction units 337 in each suction mechanism by color.

The functional liquid droplet ejection heads 17 with which functional liquids of three colors (R, G, and B) are supplied are used in the first and second embodiments. However, the number and types of colors of functional liquid supplied are optional, and the present invention can be applied to the liquid droplet ejection apparatus 1 that supplies functional liquids of six colors of R (red), G (green), B (blue), C (cyan), M (magenta), and Y (yellow) or R, G, B, LR (light red), LG (light green), and LB (light blue), for example. This arrangement can be achieved by increasing the numbers of the waste liquid tanks 281 and the suction mechanisms 204. In this case as well, the suction can be performed by a single suction mechanism as long as the viscosity of the functional liquids is equal.

Taking electro-optical apparatuses (flat panel display apparatuses) manufactured using the liquid droplet ejection apparatus 1 and active matrix substrates formed on the electro-optical apparatuses as display apparatuses as examples, configurations and manufacturing methods thereof will now be described. Examples of the electro-optical apparatuses include a color filter, a liquid crystal display apparatus, an organic EL apparatus, a plasma display apparatus (PDP (plasma display panel) apparatus), and an electron emission apparatus (FED (field emission display) apparatus and SED (surface-conduction electron emitter display) apparatus). Note that the active matrix substrate includes thin-film transistors, source lines and data lines which are electrically connected to the thin film transistors.

Figure 12:
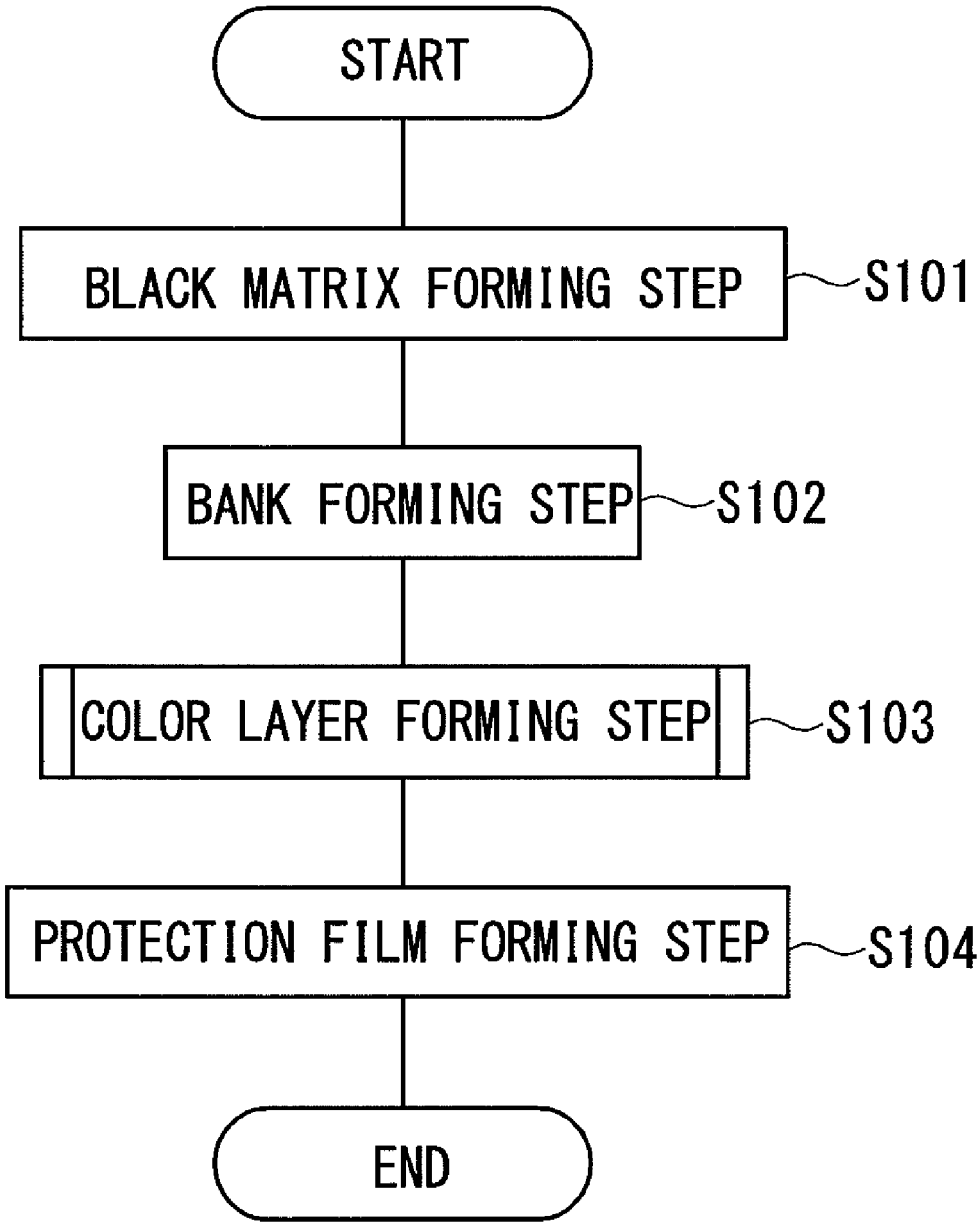
FIG. 12 is a flowchart illustrating manufacturing steps of a color filter.

First, a manufacturing method of a color filter incorporated in a liquid crystal display apparatus or an organic EL apparatus will be described. FIG. 12 shows a flowchart illustrating manufacturing steps of a color filter. FIGS. 13A to 13E are sectional views of the color filter 500 (a filter substrate 500A) of this embodiment shown in an order of the manufacturing steps.

Figure 13A:
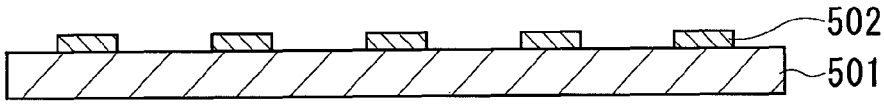
FIGS. 13A-13E are schematic sectional views in an order of manufacturing process for the color filter.

In a black matrix forming step (step S101), as shown in FIG. 13A, a black matrix 502 is formed on the substrate (W) 501. The black matrix 502 is formed of a chromium metal, a laminated body of a chromium metal and a chromium oxide, or a resin black, for example. The black matrix 502 may be formed of a thin metal film by a sputtering method or a vapor deposition method. Alternatively, the black matrix 502 may be formed of a thin resin film by a gravure plotting method, a photoresist method, or a thermal transfer method.

Figure 13B:
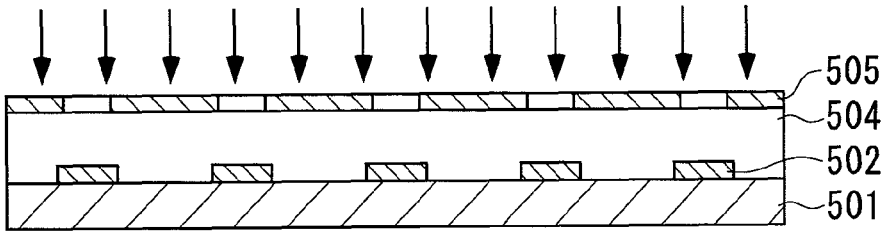

In a bank forming step (step S102), the bank 503 is formed so as to be superposed on the black matrix 502. Specifically, as shown in FIG. 13B, a resist layer 504 which is formed of a transparent negative photosensitive resin is formed so as to cover the substrate 501 and the black matrix 502. An upper surface of the resist layer 504 is covered with a mask film 505 formed in a matrix pattern. In this state, exposure processing is performed.

Figure 13C:
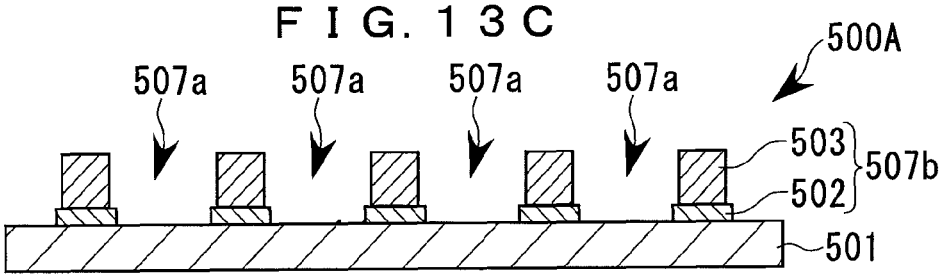

Furthermore, as shown in FIG. 13C, the resist layer 504 is patterned by performing etching processing on portions of the resist layer 504 which are not exposed, and the bank 503 is thus formed. Note that when the black matrix 502 is formed of a resin black, the black matrix 502 also serves as a bank.

The bank 503 and the black matrix 502 disposed beneath the bank 503 serve as a partition wall 507*b* for partitioning the pixel areas 507*a*. The partition wall 507*b* defines receiving areas for receiving the functional liquid ejected when the functional liquid droplet ejection heads 17 form coloring layers (film portions) 508R, 508G, and 508B in a subsequent coloring layer forming step.

The filter substrate 500A is obtained through the black matrix forming step and the bank forming step.

Note that, in this embodiment, a resin material having a lyophobic (hydrophobic) film surface is used as a material of the bank 503. Since a surface of the substrate (glass substrate) 501 is lyophilic (hydrophilic), variation of positions to which the liquid droplet is projected in the each of the pixel areas 507*a* surrounded by the bank 503 (partition wall 507*b*) can be automatically corrected in the subsequent coloring layer forming step.

Figure 13D:
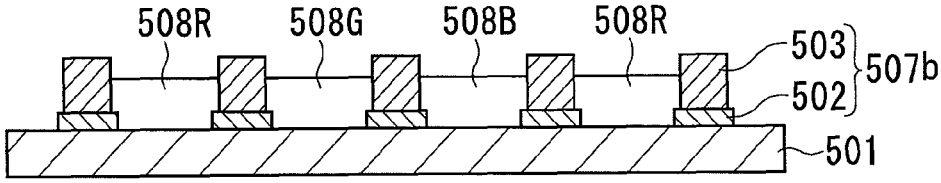

In the coloring layer forming step (S103), as shown in FIG. 13D, the functional liquid droplet ejection heads 17 eject the functional liquid within the pixel areas 507*a* each of which are surrounded by the partition wall 507*b*. In this case, the functional liquid droplet ejection heads 17 eject functional liquid droplets using functional liquid (filter materials) of colors R, G, and B. A color scheme pattern of the three colors R, G, and B may be the stripe arrangement, the mosaic arrangement, or the delta arrangement.

Figure 13E:
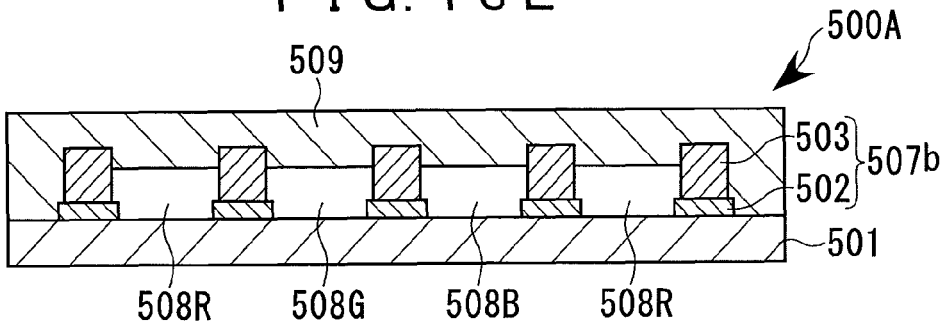

Then drying processing (such as heat treatment) is performed so that the three color functional liquid are fixed, and thus three coloring layers 508R, 508G, and 508B are formed. Thereafter, a protective film forming step is reached (step S104). As shown in FIG. 13E, a protective film 509 is formed so as to cover surfaces of the substrate 501, the partition wall 507*b*, and the three coloring layers 508R, 508G, and 508B.

That is, after liquid used for the protective film is ejected onto the entire surface of the substrate 501 on which the coloring layers 508R, 508G, and 508B are formed and the drying process is performed, the protective film 509 is formed.

In the manufacturing method of the color filter 500, after the protective film 509 is formed, a coating step is performed in which ITO (Indium Tin Oxide) serving as a transparent electrode in the subsequent step is coated.

Figure 14:
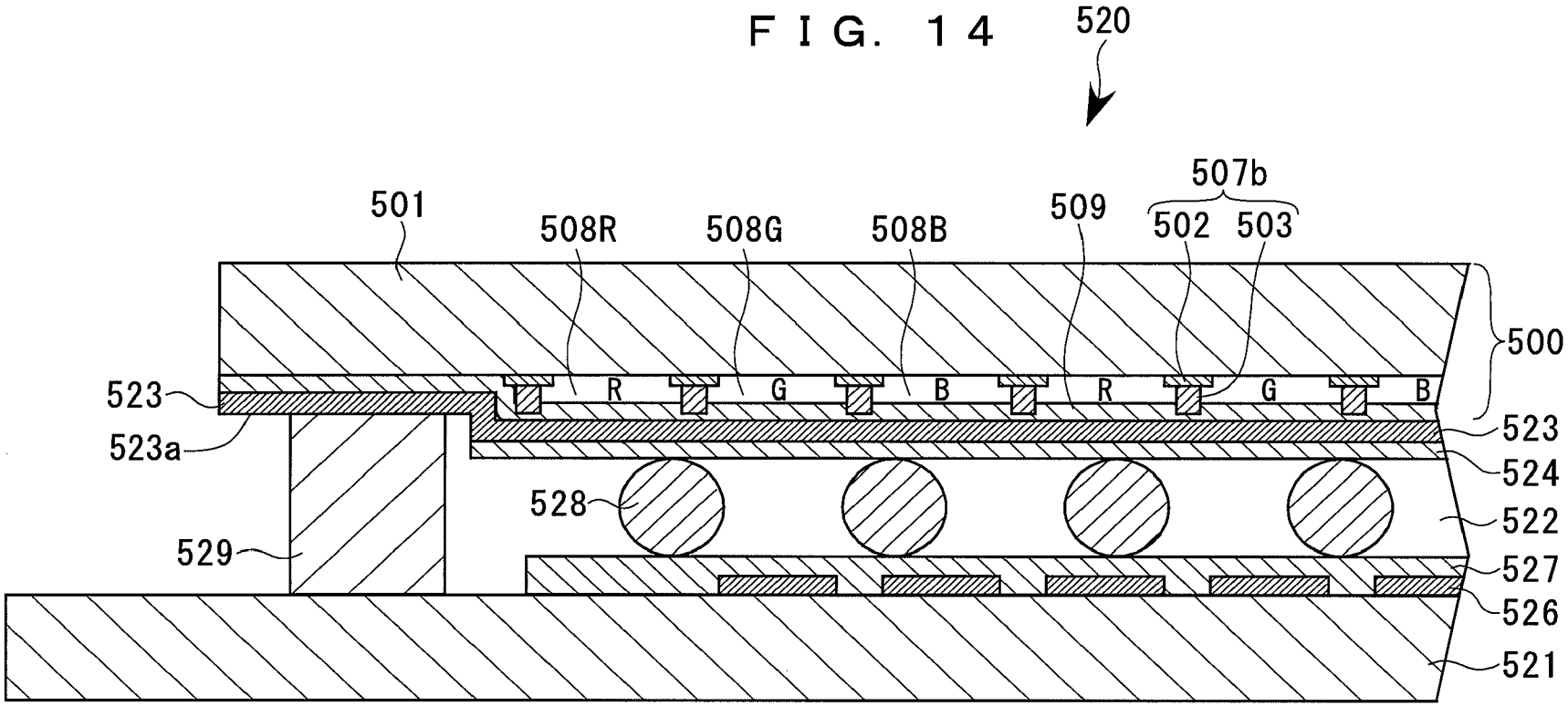
FIG. 14 is a sectional view of an essential part of a liquid crystal display using the color filter according to the invention.

FIG. 14 is a sectional view of an essential part of a passive matrix liquid crystal display apparatus (liquid crystal display apparatus 520) and schematically illustrates a configuration thereof as an example of a liquid crystal display apparatus employing the color filter 500. A transmissive liquid crystal display apparatus as a final product can be obtained by disposing a liquid crystal driving IC (integrated circuit), a backlight, and additional components such as supporting members on the display apparatus 520. Note that the color filter 500 is the same as that shown in FIGS. 13A to 13E, and therefore, reference numerals the same as those used in FIGS. 13A to 13E to denote the same components, and descriptions thereof are omitted.

The display apparatus 520 includes the color filter 500, a counter substrate 521 such as a glass substrate, and a liquid crystal layer 522 formed of STN (super twisted nematic) liquid crystal compositions sandwiched therebetween. The color filter 500 is disposed on the upper side of FIG. 14 (on an observer side).

Although not shown, polarizing plates are disposed so as to face an outer surface of the counter substrate 521 and an outer surface of the color filter 500 (surfaces which are remote from the liquid crystal layer 522). A backlight is disposed so as to face an outer surface of the polarizing plate disposed near the counter substrate 521.

A plurality of rectangular first electrodes 523 extending in a horizontal direction in FIG. 14 are formed with predetermined intervals therebetween on a surface of the protective film 509 (near the liquid crystal layer 522) of the color filter 500. A first alignment layer 524 is arranged so as to cover surfaces of the first electrodes 523 which are surfaces remote from the color filter 500.

On the other hand, a plurality of rectangular second electrodes 526 extending in a direction perpendicular to the first electrodes 523 disposed on the color filter 500 are formed with predetermined intervals therebetween on a surface of the counter substrate 521 which faces the color filter 500. A second alignment layer 527 is arranged so as to cover surfaces of the second electrodes 526 near the liquid crystal layer 522. The first electrodes 523 and the second electrodes 526 are formed of a transparent conductive material such as an ITO.

A plurality of spacers 528 disposed in the liquid crystal layer 522 are used to maintain the thickness (cell gap) of the liquid crystal layer 522 constant. A seal member 529 is used to prevent the liquid crystal compositions in the liquid crystal layer 522 from leaking to the outside. Note that an end of each of the first electrodes 523 extends beyond the seal member 529 and serves as wiring 523*a*.

Pixels are arranged at intersections of the first electrodes 523 and the second electrodes 526. The coloring layers 508R, 508G, and 508B are arranged on the color filter 500 so as to correspond to the pixels.

In normal manufacturing processing, the first electrodes 523 are patterned and the first alignment layer 524 is applied on the color filter 500 whereby a first half portion of the display apparatus 520 on the color filter 500 side is manufactured. Similarly, the second electrodes 526 are patterned and the second alignment layer 527 is applied on the counter substrate 521 whereby a second half portion of the display apparatus 520 on the counter substrate 521 side is manufactured. Thereafter, the spacers 528 and the seal member 529 are formed on the second half portion, and the first half portion is attached to the second half portion. Then, liquid crystal to be included in the liquid crystal layer 522 is injected from an inlet of the seal member 529, and the inlet is sealed. Finally, the polarizing plates and the backlight are disposed.

The liquid droplet ejection apparatus 1 of this embodiment may apply a spacer material (functional liquid) constituting the cell gap, for example, and uniformly apply liquid crystal (functional liquid) to an area sealed by the seal member 529 before the first half portion is attached to the second half portion. Furthermore, the seal member 529 may be printed using the functional liquid droplet ejection heads 17. Moreover, the first alignment layer 524 and the second alignment layer 527 may be applied using the functional liquid droplet ejection heads 17.

Figure 15:
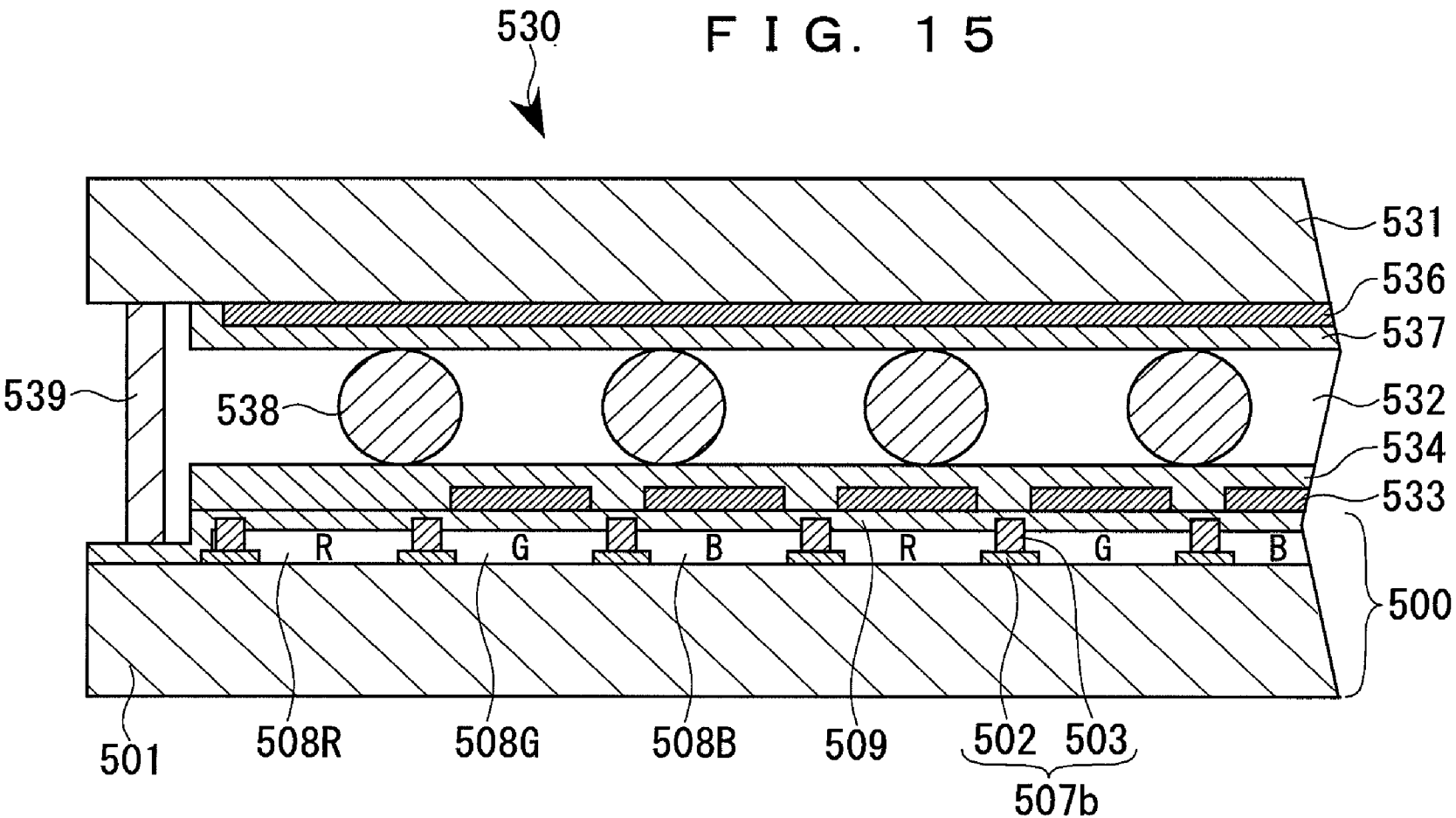
FIG. 15 is a sectional view of an essential part of a liquid crystal display as the second example using the color filter according to the invention.

FIG. 15 is a sectional view of an essential part of a display apparatus 530 and schematically illustrates a configuration thereof as a second example of a liquid crystal display apparatus employing the color filter 500 which is manufactured in this embodiment.

The display apparatus 530 is considerably different from the display apparatus 520 in that the color filter 500 is disposed on a lower side in FIG. 15 (remote from the observer).

The display apparatus 530 is substantially configured such that a liquid crystal layer 532 constituted by STN liquid crystal is arranged between the color filter 500 and a counter substrate 531 such as a glass substrate. Although not shown, polarizing plates are disposed so as to face an outer surface of the counter substrate 531 and an outer surface of the color filter 500.

A plurality of rectangular first electrodes 533 extending in a depth direction of FIG. 15 are formed with predetermined intervals therebetween on a surface of the protective film 509 (near the liquid crystal layer 532) of the color filter 500. A first alignment layer 534 is arranged so as to cover surfaces of the first electrodes 533 which are surfaces near the liquid crystal layer 532.

On the other hand, a plurality of rectangular second electrodes 536 extending in a direction perpendicular to the first electrodes 533 disposed on the color filter 500 are formed with predetermined intervals therebetween on a surface of the counter substrate 531 which faces the color filter 500. A second alignment layer 537 is arranged so as to cover surfaces of the second electrodes 536 near the liquid crystal layer 532.

A plurality of spacers 538 disposed in the liquid crystal layer 532 are used to maintain the thickness (cell gap) of the liquid crystal layer 532 constant. A seal member 539 is used to prevent the liquid crystal compositions in the liquid crystal layer 532 from leaking to the outside.

As with the display apparatus 520, pixels are arranged at intersections of the first electrodes 533 and the second electrodes 536. The coloring layers 508R, 508G, and 508B are arranged on the color filter 500 so as to correspond to the pixels.

Figure 16:
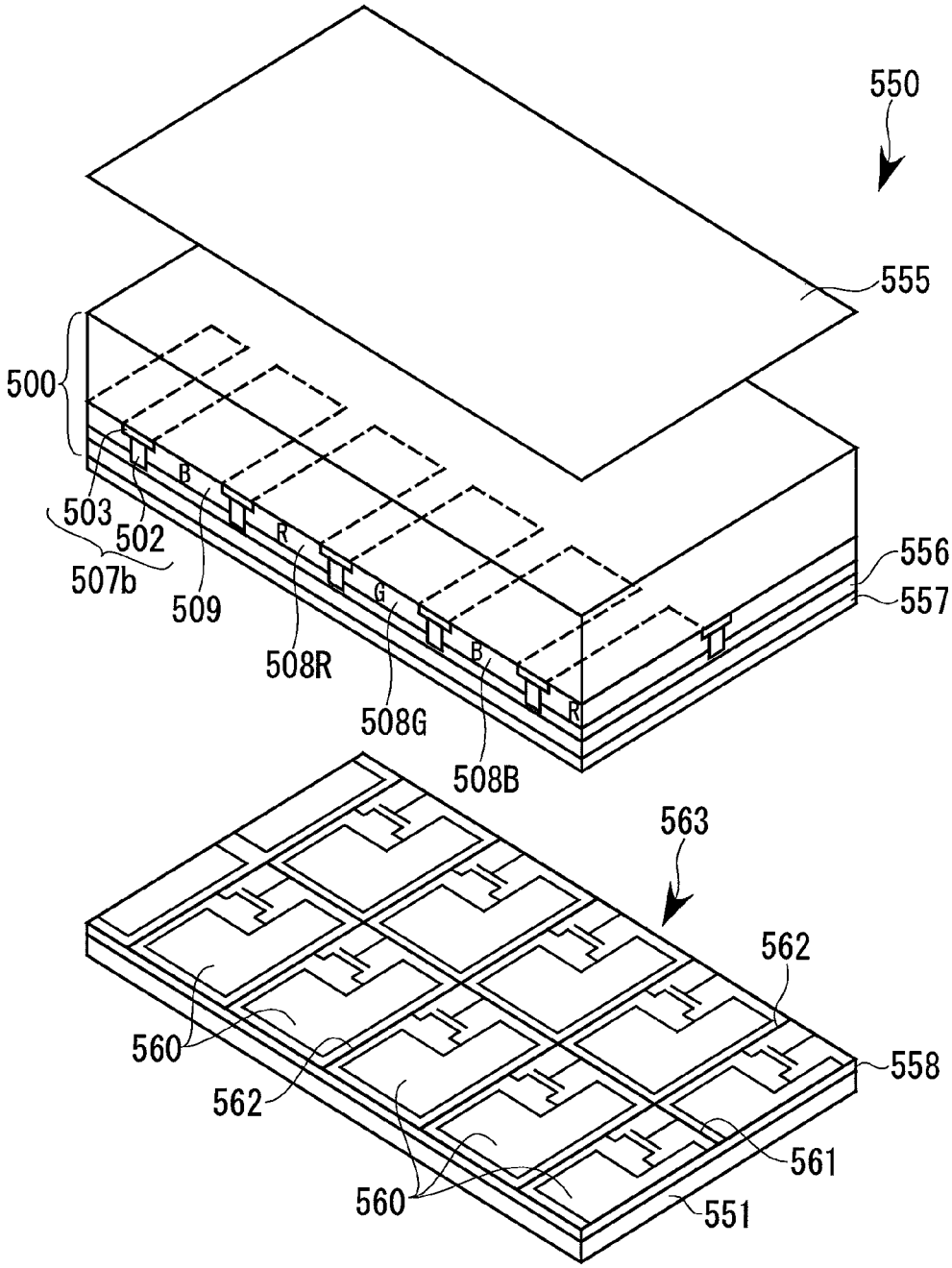
FIG. 16 is a sectional view of an essential part of a liquid crystal display as the third example using the color filter according to the invention.

FIG. 16 is an exploded perspective view of a transmissive TFT (thin film transistor) liquid crystal display device and schematically illustrates a configuration thereof as a third example of a liquid crystal display apparatus employing the color filter 500 to which the invention is applied.

A liquid crystal display apparatus 550 has the color filter 500 disposed on the upper side of FIG. 16 (on the observer side).

The liquid crystal display apparatus 550 includes the color filter 500, a counter substrate 551 disposed so as to face the color filter 500, a liquid crystal layer (not shown) interposed therebetween, a polarizing plate 555 disposed so as to face an upper surface of the color filter 500 (on the observer side), and a polarizing plate (not shown) disposed so as to face a lower surface of the counter substrate 551.

An electrode 556 used for driving the liquid crystal is formed on a surface of the protective film 509 (a surface near the counter substrate 551) of the color filter 500. The electrode 556 is formed of a transparent conductive material such as an ITO and entirely covers an area in which pixel electrodes 560 are to be formed which will be described later. An alignment layer 557 is arranged so as to cover a surface of the electrode 556 remote from the pixel electrode 560.

An insulating film 558 is formed on a surface of the counter substrate 551 which faces the color filter 500. On the insulating film 558, scanning lines 561 and signal lines 562 are arranged so as to intersect with each other. Pixel electrodes 560 are formed in areas surrounded by the scanning lines 561 and the signal lines 562. Note that an alignment layer (not shown) is arranged on the pixel electrodes 560 in an actual liquid crystal display apparatus.

Thin-film transistors 563 each of which includes a source electrode, a drain electrode, a semiconductor layer, and a gate electrode are incorporated in areas surrounded by notch portions of the pixel electrodes 560, the scanning lines 561, and the signal lines 562. When signals are supplied to the scanning lines 561 and the signal lines 562, the thin-film transistors 563 are turned on or off so that power supply to the pixel electrodes 560 is controlled.

Note that although each of the display apparatuses 520, 530, and 550 is configured as a transmissive liquid crystal display apparatus, each of the display apparatuses 520, 530, and 550 may be configured as a reflective liquid crystal display apparatus having a reflective layer or a semi-transmissive liquid crystal display apparatus having a semi-transmissive reflective layer.

Figure 17:
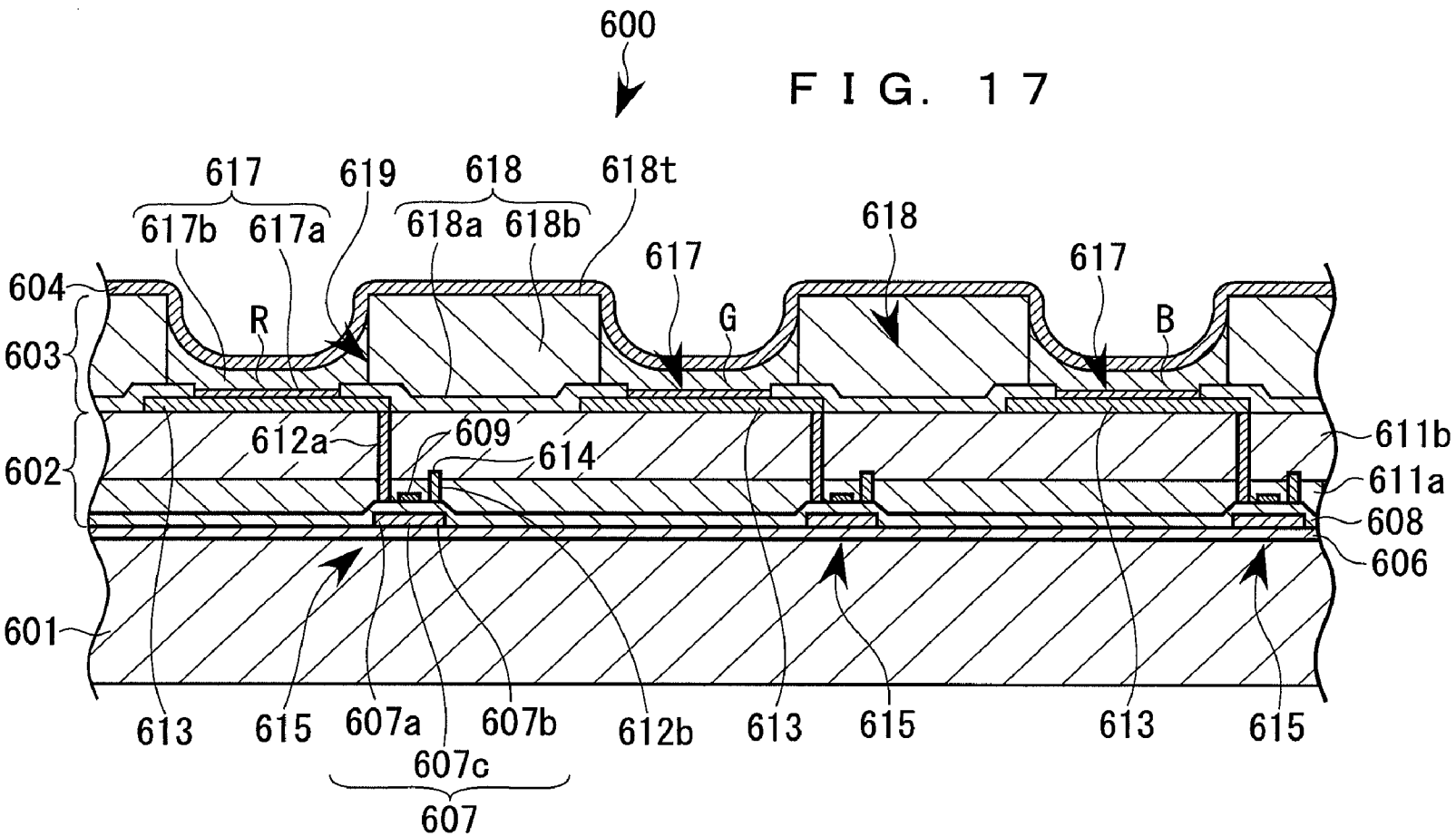
FIG. 17 is a sectional view of an essential part of a display as an organic EL apparatus.

FIG. 17 is a sectional view illustrating an essential part of a display area of an organic EL apparatus (hereinafter simply referred to as a display apparatus 600).

In this display apparatus 600, a circuit element portion 602, a light-emitting element portion 603, and a cathode 604 are laminated on a substrate (W) 601.

In this display apparatus 600, light is emitted from the light-emitting element portion 603 through the circuit element portion 602 toward the substrate 601 and eventually is emitted to an observer side. In addition, light emitted from the light-emitting element portion 603 toward an opposite side of the substrate 601 is reflected by the cathode 604, and thereafter passes through the circuit element portion 602 and the substrate 601 to be emitted to the observer side.

An underlayer protective film 606 formed of a silicon oxide film is arranged between the circuit element portion 602 and the substrate 601. Semiconductor films 607 formed of polysilicon oxide films are formed on the underlayer protective film 606 (near the light-emitting element portion 603) in an isolated manner. In each of the semiconductor films 607, a source region 607*a* and a drain region 607*b* are formed on the left and right sides thereof, respectively, by high-concentration positive-ion implantation. The center portion of each of the semiconductor films 607 which is not subjected to high-concentration positive-ion implantation serves as a channel region 607*c*.

In the circuit element portion 602, the underlayer protective film 606 and a transparent gate insulating film 608 covering the semiconductor films 607 are formed. Gate electrodes 609 formed of, for example, Al, Mo, Ta, Ti, or W are disposed on the gate insulating film 608 so as to correspond to the channel regions 607*c* of the semiconductor films 607. A first transparent interlayer insulating film 611*a* and a second transparent interlayer insulating film 611*b* are formed on the gate electrodes 609 and the gate insulating film 608. Contact holes 612*a* and 612*b* are formed so as to penetrate the first interlayer insulating film 611*a* and the second interlayer insulating film 611*b* and to be connected to the source region 607*a* and the drain region 607*b* of the semiconductor films 607.

Pixel electrodes 613 which are formed of ITOs, for example, and which are patterned to have a predetermined shape are formed on the second interlayer insulating film 611*b*. The pixel electrode 613 is connected to the source region 607*a* through the contact holes 612*a*.

Power source lines 614 are arranged on the first interlayer insulating film 611*a*. The power source lines 614 are connected through the contact holes 612*b* to the drain region 607*b*.

As shown in FIG. 17, the circuit element portion 602 includes thin-film transistors 615 connected to drive the respective pixel electrodes 613.

The light-emitting element portion 603 includes functional layers 617 each formed on a corresponding one of pixel electrodes 613, and bank portions 618 which are formed between the pixel electrodes 613 and the functional layers 617 and which are used to partition the functional layers 617 from one another.

The pixel electrodes 613, the functional layers 617, and the cathode 604 formed on the functional layers 617 constitute the light-emitting element. Note that the pixel electrodes 613 are formed into a substantially rectangular shape in plan view by patterning, and the bank portions 618 are formed so that each two of the pixel electrodes 613 sandwich a corresponding one of the bank portions 618.

Each of the bank portions 618 includes an inorganic bank layer 618*a* (first bank layer) formed of an inorganic material such as SiO, $SiO_2$, or $TiO_2$, and an organic bank layer 618*b*

(second bank layer) which is formed on the inorganic bank layer 618*a* and has a trapezoidal shape in a sectional view. The organic bank layer 618*b* is formed of a resist, such as an acrylic resin or a polyimide resin, which has an excellent heat resistance and an excellent lyophobic characteristic. A part of each of the bank portions 618 overlaps peripheries of corresponding two of the pixel electrodes 613 which sandwich each of the bank portions 618.

Openings 619 are formed between the bank portions 618 so as to gradually increase in size upwardly against the pixel electrodes 613.

Each of the functional layers 617 includes a positive-hole injection/transport layer 617*a* formed so as to be laminated on the pixel electrodes 613 and a light-emitting layer 617*b* formed on the positive-hole injection/transport layer 617*a*. Note that another functional layer having another function may be arranged so as to be arranged adjacent to the light-emitting layer 617*b*. For example, an electronic transport layer may be formed.

The positive-hole injection/transport layer 617*a* transports positive holes from a corresponding one of the pixel electrodes 613 and injects the transported positive holes to the light-emitting layer 617*b*. The positive-hole injection/transport layer 617*a* is formed by ejection of a first composition (functional liquid) including a positive-hole injection/transport layer forming material. The positive-hole injection/transport layer forming material may be a known material.

The light-emitting layer 617*b* is used for emission of light having colors red (R), green (G), or blue (B), and is formed by ejection of a second composition (functional liquid) including a material for forming the light-emitting layer 617*b* (light-emitting material). As a solvent of the second composition (nonpolar solvent), a known material which is insoluble to the positive-hole injection/transport layer 617*a* is preferably used. Since such a nonpolar solvent is used as the second composition of the light-emitting layer 617*b*, the light-emitting layer 617*b* can be formed without dissolving the positive-hole injection/transport layer 617*a* again.

The light-emitting layer 617*b* is configured such that the positive holes injected from the positive-hole injection/transport layer 617*a* and electrons injected from the cathode 604 are recombined in the light-emitting layer 617*b* so as to emit light.

The cathode 604 is formed so as to cover an entire surface of the light-emitting element portion 603, and in combination with the pixel electrodes 613, supplies current to the functional layers 617. Note that a sealing member (not shown) is arranged on the cathode 604.

Steps of manufacturing the display apparatus 600 will now be described with reference to FIGS. 18 to 26.

Figure 18:
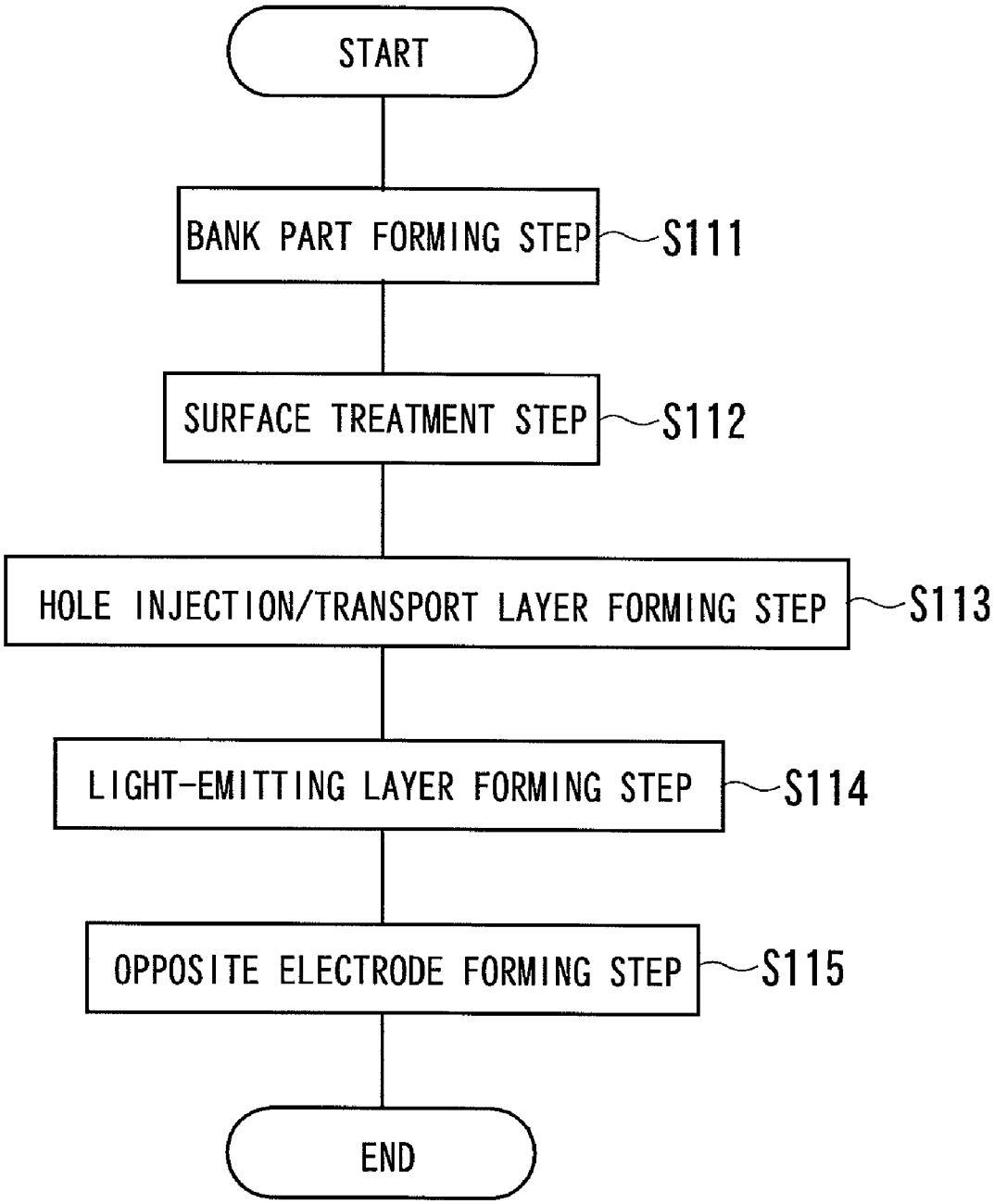
FIG. 18 is a flowchart illustrating manufacturing steps of the display as the organic EL apparatus.

As shown in FIG. 18, the display apparatus 600 is manufactured through a bank portion forming step (S111), a surface processing step (S112), a positive-hole injection/transport layer forming step (S113), a light-emitting layer forming step (S114), and a counter electrode forming step (S115). Note that the manufacturing steps are not limited to these examples shown in FIG. 16, and one of these steps may be omitted or another step may be added according as desired.

Figure 19:
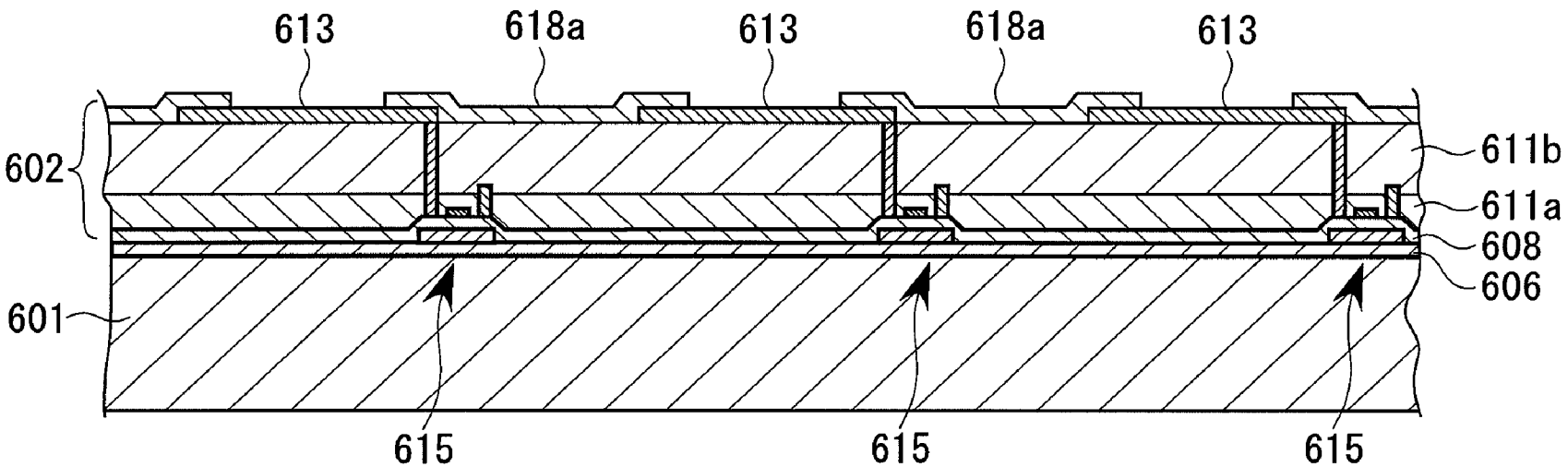
FIG. 19 is a process chart illustrating formation of an inorganic bank layer.

In the bank portion forming step (S111), as shown in FIG. 19, the inorganic bank layers 618*a* are formed on the second interlayer insulating film 611*b*. The inorganic bank layers 618*a* are formed by forming an inorganic film at a desired position and by patterning the inorganic film by the photolithography technique. At this time, a part of each of the inorganic bank layers 618*a* overlaps peripheries of corresponding two of the pixel electrodes 613 which sandwich each of the inorganic bank layers 618*a*.

Figure 20:
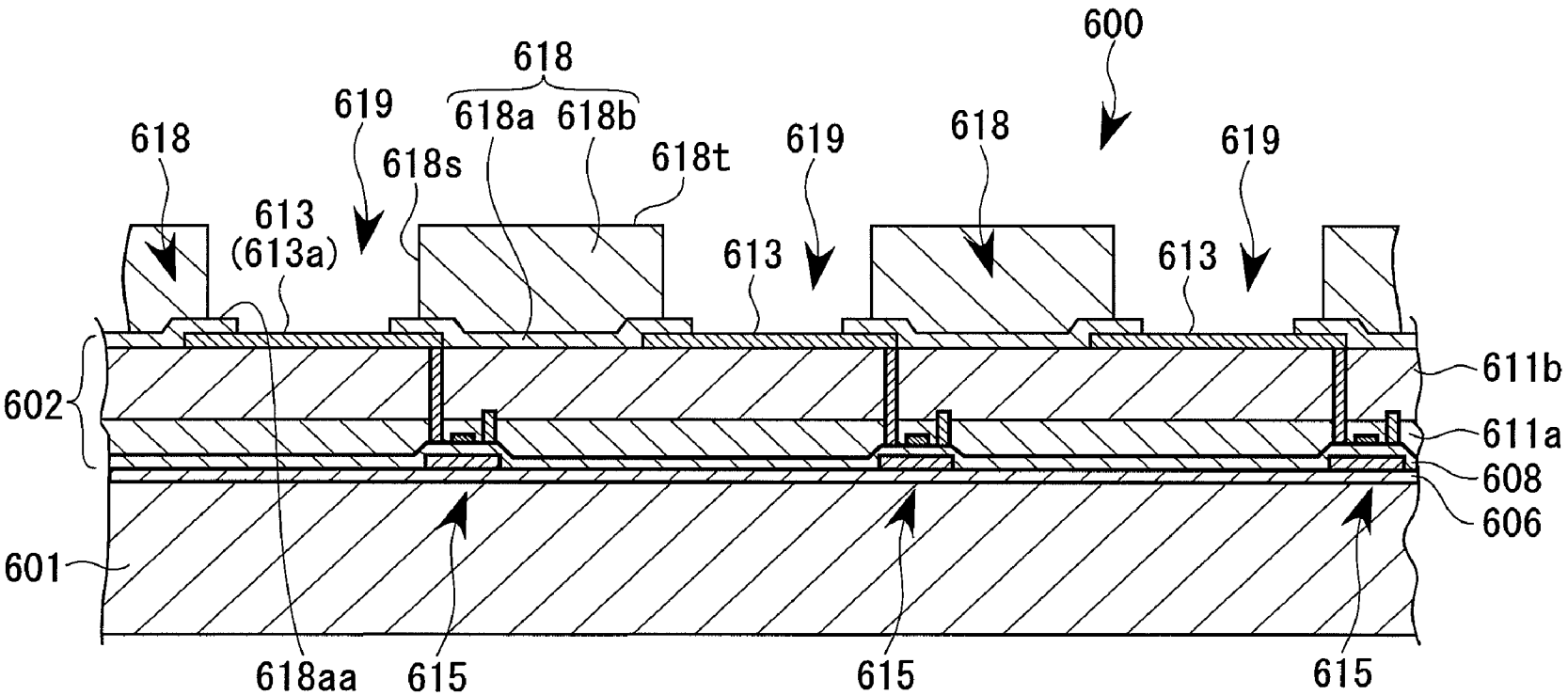
FIG. 20 is a process chart illustrating formation of an organic bank layer.

After the inorganic bank layers 618*a* are formed, as shown in FIG. 20, the organic bank layers 618*b* are formed on the inorganic bank layers 618*a*. As with the inorganic bank layers 618*a*, the organic bank layers 618*b* are formed by patterning a formed organic film by the photolithography technique.

The bank portions 618 are thus formed. When the bank portions 618 are formed, the openings 619 opening upward relative to the pixel electrodes 613 are formed between the bank portions 618. The openings 619 define pixel areas.

In the surface processing step (S112), a hydrophilic treatment and a repellency treatment are performed. The hydrophilic treatment is performed on first lamination areas 618*aa* of the inorganic bank layers 618*a* and electrode surfaces 613*a* of the pixel electrodes 613. The hydrophilic treatment is performed, for example, by plasma processing using oxide as a processing gas on surfaces of the first lamination areas 618*aa* and the electrode surfaces 613*a* to have hydrophilic properties. By performing the plasma processing, the ITO forming the pixel electrodes 613 is cleaned.

The repellency treatment is performed on walls 618*s* of the organic bank layers 618*b* and upper surfaces 618*t* of the organic bank layers 618*b*. The repellency treatment is performed as a fluorination treatment, for example, by plasma processing using tetrafluoromethane as a processing gas on the walls 618*s* and the upper surfaces 618*t*.

By performing this surface processing step, when the functional layers 617 is formed using the functional liquid droplet ejection heads 17, the functional liquid droplets are ejected onto the pixel areas with high accuracy. Furthermore, the functional liquid droplets attached onto the pixel areas are prevented from flowing out of the openings 619.

A display apparatus body 600A is obtained through these steps. The display apparatus body 600A is mounted on the set table 21 of the liquid droplet ejection apparatus 1 shown in FIG. 1 and the positive-hole injection/transport layer forming step (S113) and the light-emitting layer forming step (S114) are performed thereon.

Figure 21:
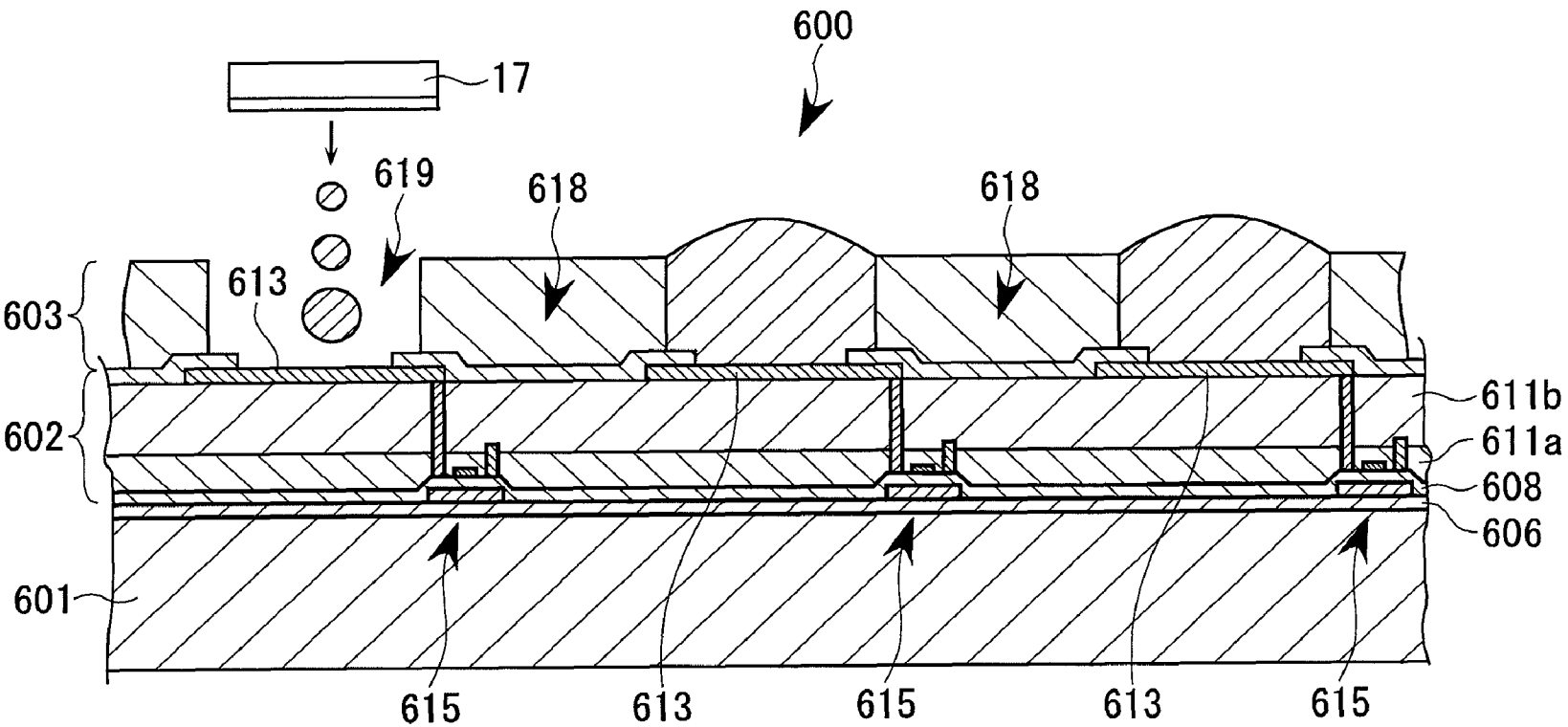
FIG. 21 is a process chart illustrating processes of forming a positive-hole injection/transport layer.
Figure 22:
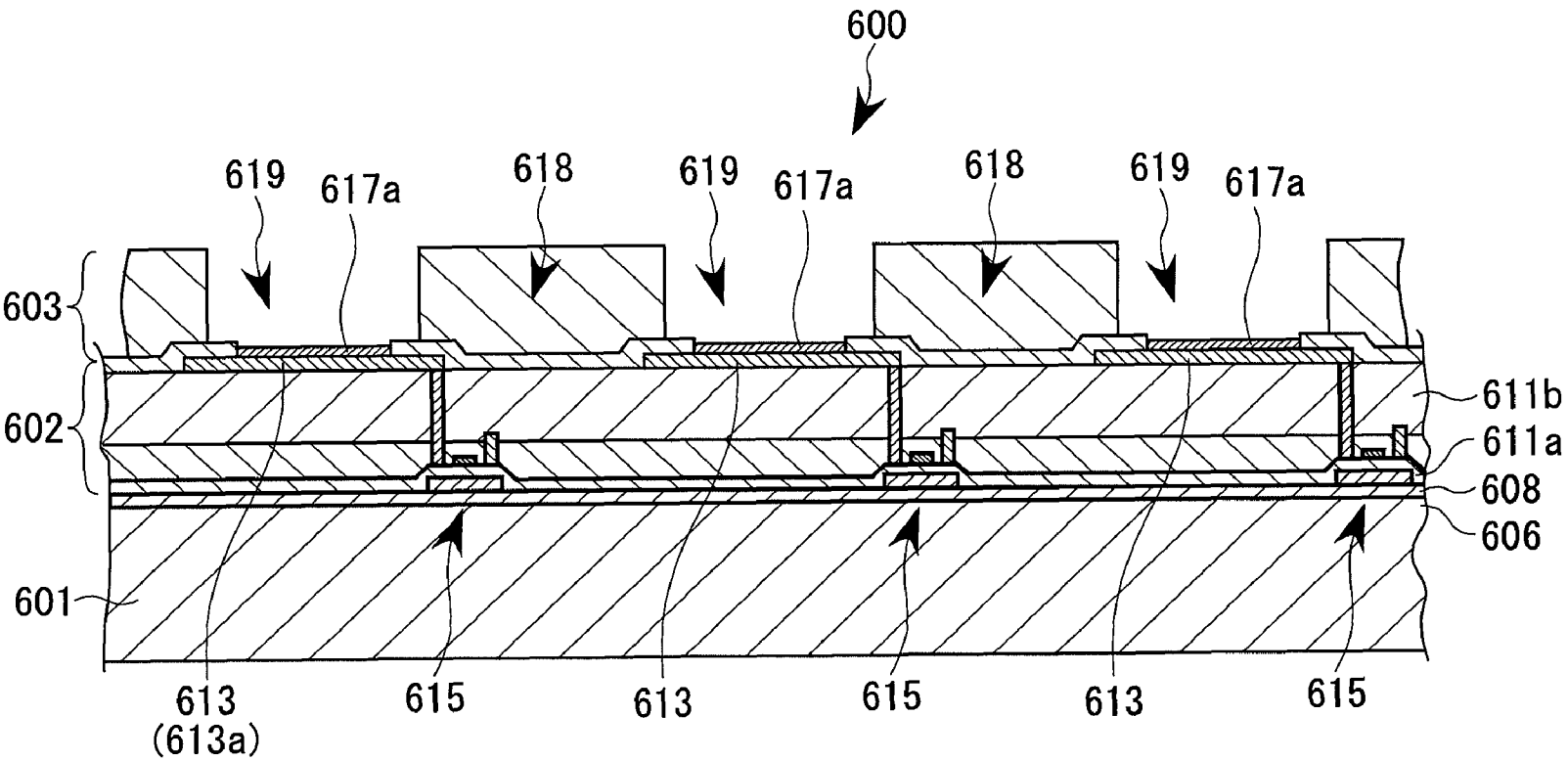
FIG. 22 is a process chart illustrating a state where the positive-hole injection/transport layer has been formed.

As shown in FIG. 21, in the positive-hole injection/transport layer forming step (S113), the first compositions including the material for forming a positive-hole injection/transport layer are ejected from the functional liquid droplet ejection heads 17 into the openings 619 included in the pixel areas. Thereafter, as shown in FIG. 22, drying processing and a thermal treatment are performed to evaporate polar solution included in the first composition whereby the positive-hole injection/transport layers 617*a* are formed on the pixel electrodes 613 (electrode surface 613*a*).

The light-emitting layer forming step (S114) will now be described. In the light-emitting layer forming step, as described above, a nonpolar solvent which is insoluble to the positive-hole injection/transport layers 617*a* is used as the solvent of the second composition used at the time of forming the light-emitting layer in order to prevent the positive-hole injection/transport layers 617*a* from being dissolved again.

On the other hand, since each of the positive-hole injection/transport layers 617*a* has low affinity to a nonpolar solvent, even when the second composition including the nonpolar solvent is ejected onto the positive-hole injection/transport layers 617*a*, the positive-hole injection/transport layers 617*a* may not be brought into tight contact with the light-emitting layers 617*b* or the light-emitting layers 617*b* may not be uniformly applied.

Accordingly, before the light-emitting layers 617*b* are formed, surface processing (surface improvement processing) is preferably performed so that each of the positive-hole injection/transport layers 617*a* has high affinity to the nonpolar solvent and to the material for forming the light-emitting layers. The surface processing is performed by applying a solvent the same as or similar to the nonpolar solvent of the second composition used at the time of forming the light-emitting layers on the positive-hole injection/transport layers 617*a* and by drying the applied solvent.

Employment of this surface processing allows the surface of the positive-hole injection/transport layers 617*a* to have high affinity to the nonpolar solvent, and therefore, the second composition including the material for forming the light-emitting layers can be uniformly applied to the positive-hole injection/transport layers 617*a* in the subsequent step.

Figure 23:
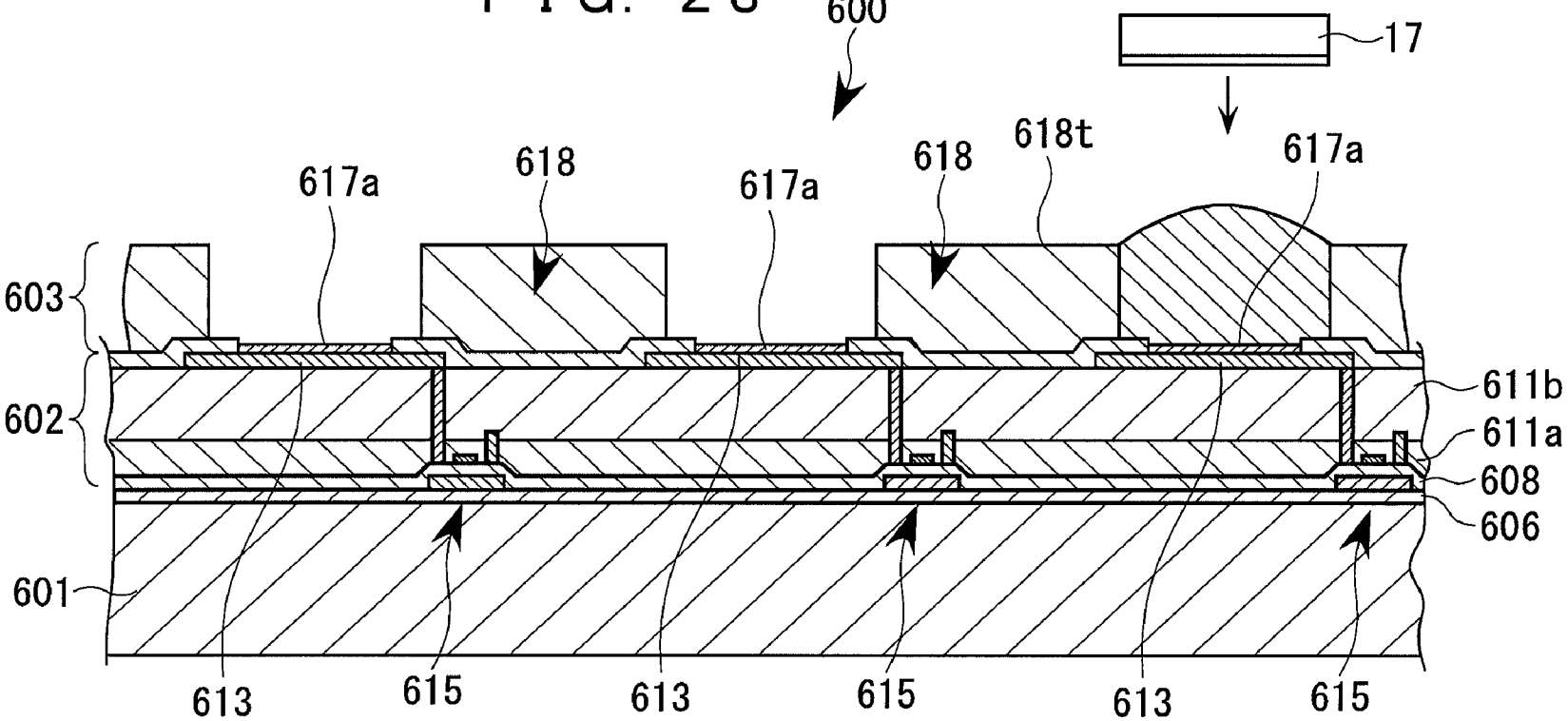
FIG. 23 is a process chart illustrating processes for forming a light-emitting layer having a blue color component.

As shown in FIG. 23, a predetermined amount of second composition including the material for forming the light-emission layers of one of the three colors (blue color (B) in an example of FIG. 23) is ejected into the pixel areas (openings 619) as functional liquid. The second composition ejected into the pixel areas spreads over the positive-hole injection/transport layer 617*a* and fills the openings 619. Note that, even if the second composition is ejected and attached to the upper surfaces 618*t* of the bank portions 618 which are outside of the pixel area, since the repellency treatment has been performed on the upper surfaces 618*t* as described above, the second component easily drops into the openings 619.

Figure 24:
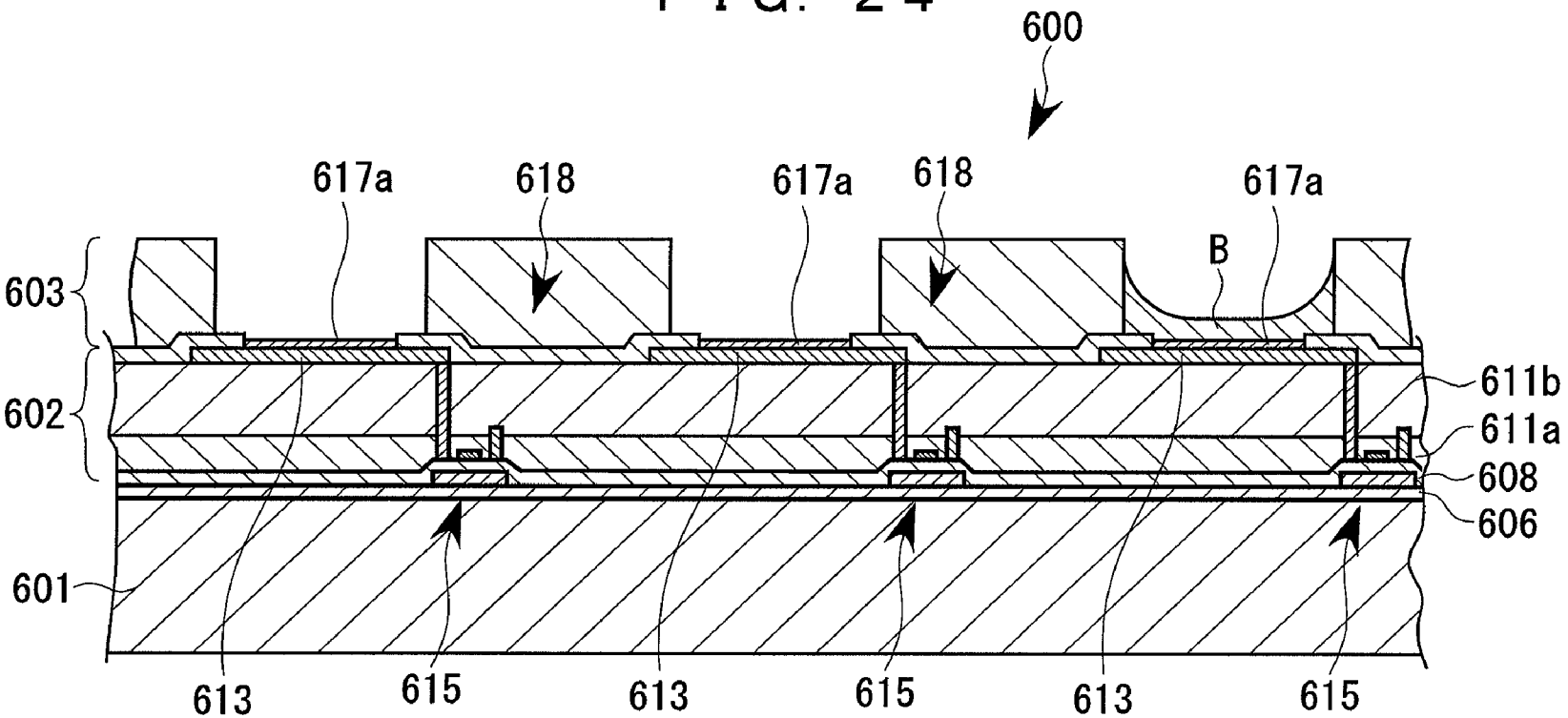
FIG. 24 is a process chart illustrating a state where the light-emitting layer having a blue color component has been formed.

Thereafter, the drying processing is performed so that the ejected second composition is dried and the nonpolar solvent included in the second composition is evaporated whereby the light-emitting layers 617*b* are formed on the positive-hole injection/transport layers 617*a* as shown in FIG. 24. In FIG. 24, one of the light-emitting layers 617*b* corresponding to the blue color (B) is formed.

Figure 25:
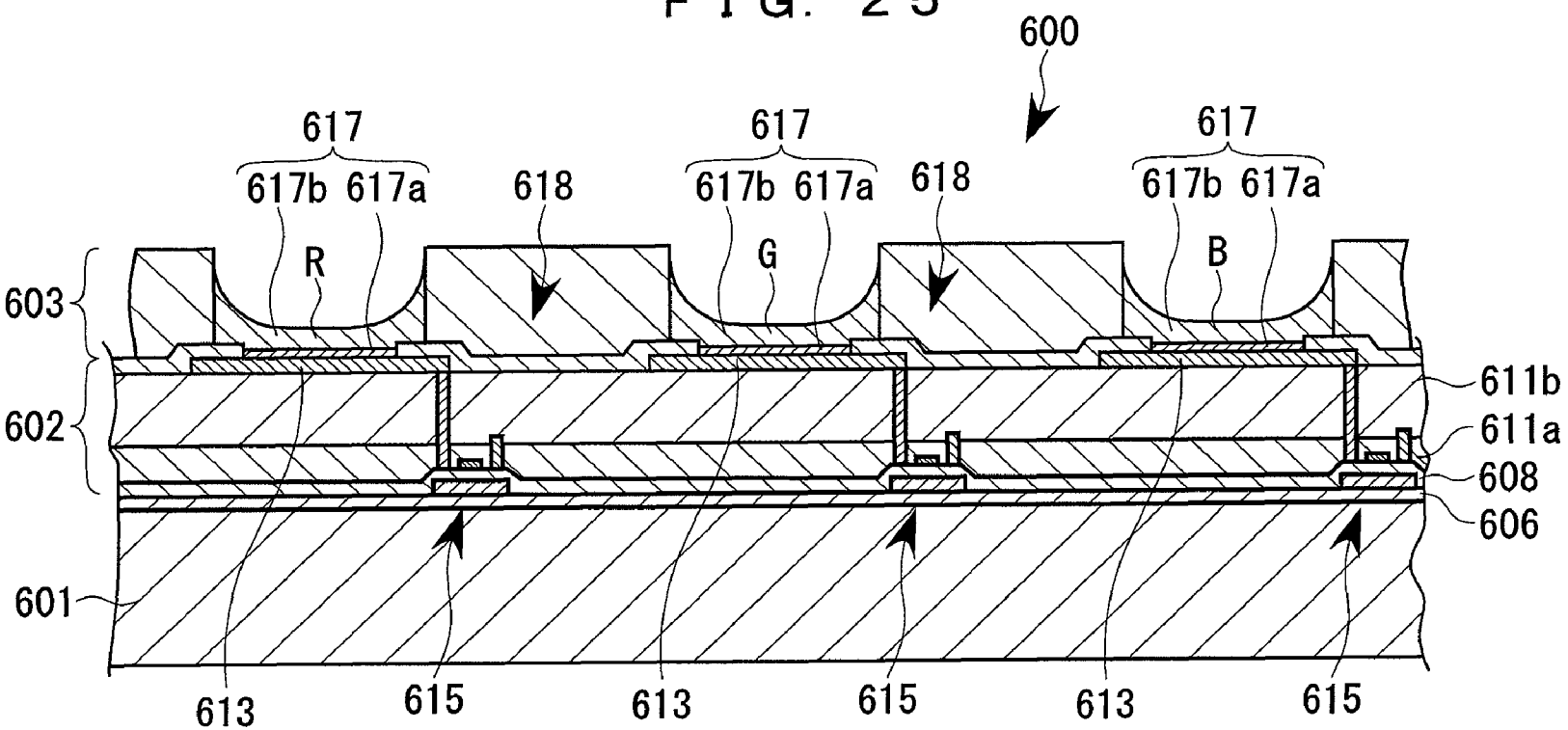
FIG. 25 is a process chart illustrating a state where light-emitting layers having three color components have been formed.

Similarly, as shown in FIG. 25, a step similar to the above-described step of forming the light-emitting layers 617*b* corresponding to the blue color (B) is repeatedly performed by using functional liquid droplet ejection heads 17 so that the light-emitting layers 617*b* corresponding to other colors (red (R) and green (G)) are formed. Note that the order of formation of the light-emitting layers 617*b* is not limited to the order described above as an example, and any other orders may be applicable. For example, an order of forming the light-emitting layers 617*b* may be determined in accordance with a light-emitting layer forming material. Furthermore, the color scheme pattern of the three colors R, G, and B may be the stripe arrangement, the mosaic arrangement, or the delta arrangement.

As described above, the functional layers 617, that is, the positive-hole injection/transport layers 617*a* and the light-emitting layers 617*b* are formed on the pixel electrodes 613. Then, the process proceeds to the counter electrode forming step (S115).

Figure 26:
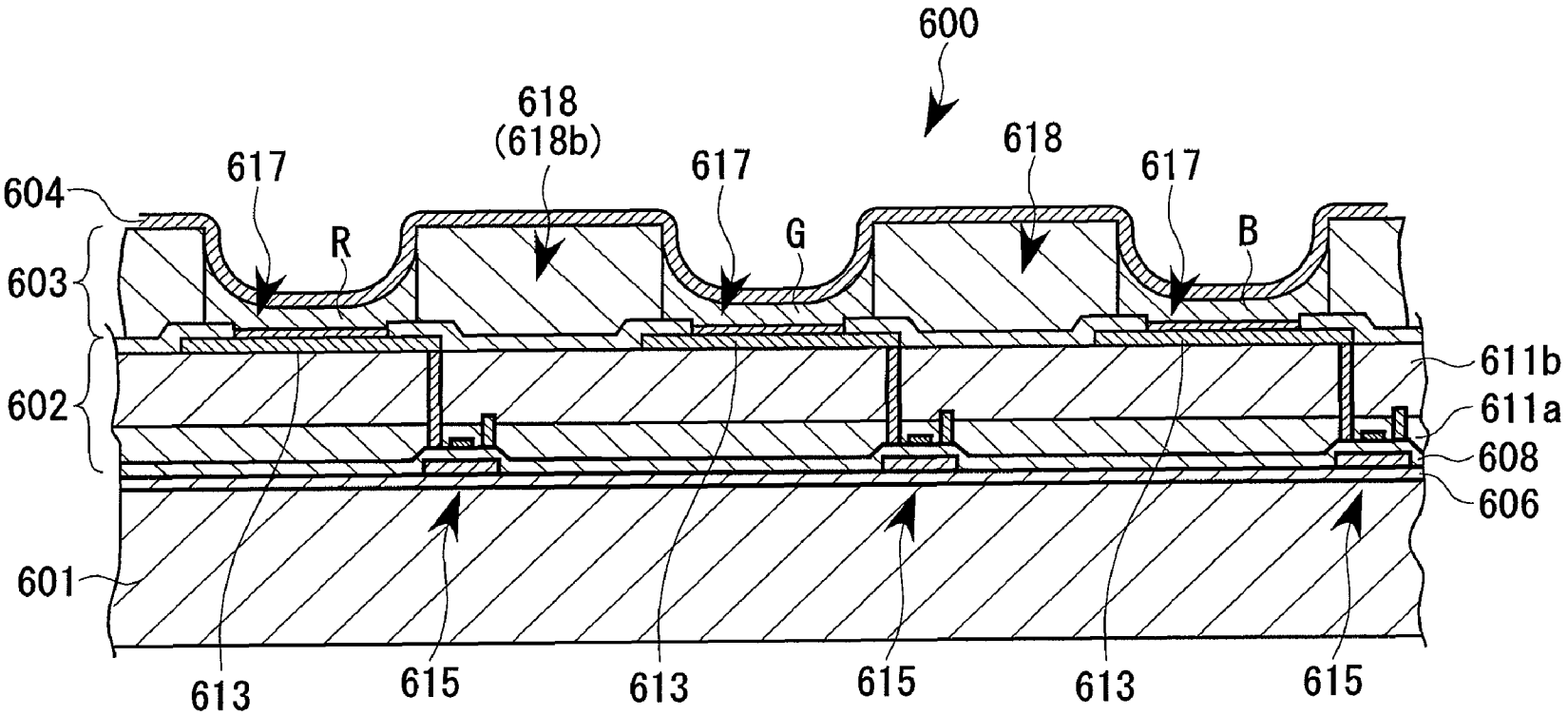
FIG. 26 is a process chart illustrating processes for forming a cathode.

In the counter electrode forming step (S115), as shown in FIG. 26, the cathode (counter electrode) 604 is formed on entire surfaces of the light-emitting layers 617*b* and the organic bank layers 618*b* by an evaporation method, sputtering, or a CVD (chemical vapor deposition) method, for example. The cathode 604 is formed by laminating a calcium layer and an aluminum layer, for example, in this embodiment.

An Al film and a Ag film as electrodes and a protective layer formed of $SiO_2$ or SiN for preventing the Al film and the Ag film from being oxidized are formed on the cathode 604.

After the cathode 604 is thus formed, other processes such as sealing processing of sealing a top surface of the cathode 604 with a sealing member and wiring processing are performed whereby the display apparatus 600 is obtained.

Figure 27:
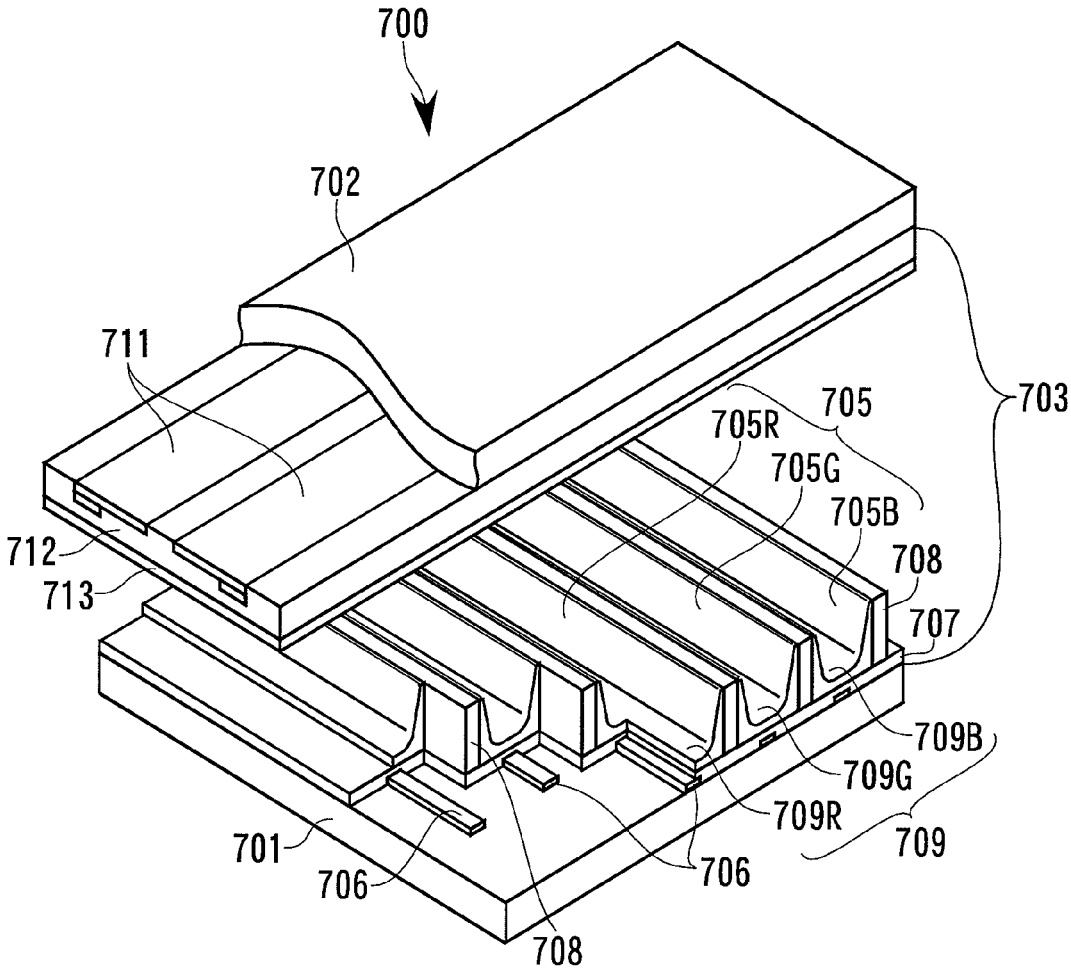
FIG. 27 is a perspective view illustrating an essential part of a plasma display apparatus (PDP apparatus).

FIG. 27 is an exploded perspective view of an essential part of a plasma display apparatus (PDP apparatus: hereinafter simply referred to as a display apparatus 700). Note that, in FIG. 27, the display apparatus 700 is partly cut away.

The display apparatus 700 includes a first substrate 701, a second substrate 702 which faces the first substrate 701, and a discharge display portion 703 interposed therebetween. The discharge display portion 703 includes a plurality of discharge chambers 705. The discharge chambers 705 include red discharge chambers 705R, green discharge chambers 705G, and blue discharge chambers 705B, and are arranged so that one of the red discharge chambers 705R, one of the green discharge chambers 705G, and one of the blue discharge chambers 705B constitute one pixel as a group.

Address electrodes 706 are arranged on the first substrate 701 with predetermined intervals therebetween in a stripe pattern, and a dielectric layer 707 is formed so as to cover top surfaces of the address electrodes 706 and the first substrate 701. Partition walls 708 are arranged on the dielectric layer 707 so as to be arranged along with the address electrodes 706 in a standing manner between the adjacent address electrodes 706. Some of the partition walls 708 extend in a width direction of the address electrodes 706 as shown in FIG. 25, and the others (not shown) extend perpendicular to the address electrodes 706.

Regions partitioned by the partition walls 708 serve as the discharge chambers 705.

The discharge chambers 705 include respective fluorescent substances 709. Each of the fluorescent substances 709 emits light having one of the colors of red (R), green (G) and blue (B). The red discharge chamber 705R has a red fluorescent substance 709R on its bottom surface, the green discharge chamber 705G has a green fluorescent substance 709G on its bottom surface, and the blue discharge chamber 705B has a blue fluorescent substance 709B on its bottom surface.

On a lower surface of the second substrate 702 in FIG. 27, a plurality of display electrodes 711 are formed with predetermined intervals therebetween in a stripe manner in a direction perpendicular to the address electrodes 706. A dielectric layer 712 and a protective film 713 formed of MgO, for example, are formed so as to cover the display electrodes 711.

The first substrate 701 and the second substrate 702 are attached so that the address electrodes 706 are arranged perpendicular to the display electrodes 711. Note that the address electrodes 706 and the display electrodes 711 are connected to an alternate power source (not shown).

When the address electrodes 706 and the display electrodes 711 are brought into conduction states, the fluorescent substances 709 are excited and emit light whereby display with colors is achieved.

In this embodiment, the address electrodes 706, the display electrodes 711, and the fluorescent substances 709 may be formed using the liquid droplet ejection apparatus 1 shown in FIG. 1. Steps of forming the address electrodes 706 on the first substrate 701 are described hereinafter.

The steps are performed in a state where the first substrate 701 is mounted on the set table 21 on the liquid droplet ejection apparatus 1.

The functional liquid droplet ejection heads 17 eject a liquid material (functional liquid) including a material for forming a conducting film wiring as functional droplets to be attached onto regions for forming the address electrodes 706. The material for forming a conducting film wiring included in the liquid material is formed by dispersing conductive fine particles such as those of a metal into dispersed media. Examples of the conductive fine particles include a metal fine particle including gold, silver, copper, palladium, or nickel, and a conductive polymer.

When ejection of the liquid material onto all the desired regions for forming the address electrodes 706 is completed, the ejected liquid material is dried, and the disperse media included in the liquid material is evaporated whereby the address electrodes 706 are formed.

Although the steps of forming the address electrodes 706 are described as an example above, the display electrodes 711 and the fluorescent substances 709 may be formed by the steps described above.

In a case where the display electrodes 711 are formed, as with the address electrodes 706, a liquid material (functional liquid) including a material for forming a conducting film wiring is ejected from the functional liquid droplet ejection heads 17 as liquid droplets to be attached to the areas for forming the display electrodes.

In a case where the fluorescent substances 709 are formed, a liquid material including fluorescent materials corresponding to three colors (R, G, and B) is ejected as liquid droplets from the functional liquid droplet ejection heads 17 so that liquid droplets having the three colors (R, G, and B) are attached within the discharge chambers 705.

Figure 28:
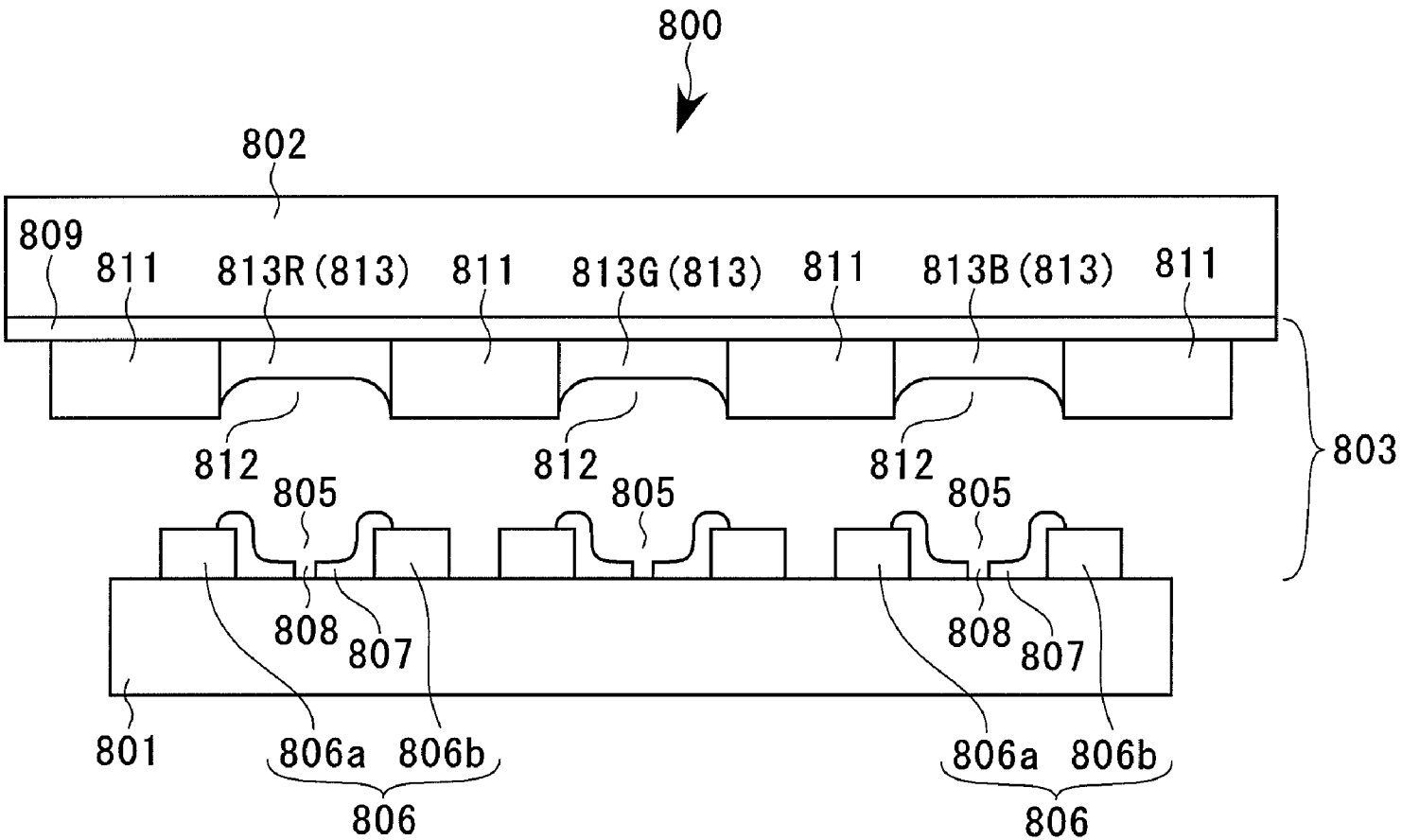
FIG. 28 is a sectional view illustrating an essential part of an electron emission display apparatus (FED apparatus).

FIG. 28 shows a sectional view of an essential part of an electron emission apparatus (also referred to as a FED apparatus or a SED apparatus: hereinafter simply referred to as a display apparatus 800). In FIG. 28, a part of the display apparatus 800 is shown in the sectional view.

The display apparatus 800 includes a first substrate 801, a second substrate 802 which faces the first substrate 801, and a field-emission display portion 803 interposed therebetween. The field-emission display portion 803 includes a plurality of electron emission portions 805 arranged in a matrix.

First element electrodes 806*a* and second element electrodes 806*b*, and conductive films 807 are arranged on the first substrate 801. The first element electrodes 806*a* and the second element electrodes 806*b* intersect with each other. Cathode electrodes 806 are formed on the first substrate 801, and each of the cathode electrodes 806 is constituted by one of the first element electrodes 806*a* and one of the second element electrodes 806*b*. In each of the cathode electrodes 806, one of the conductive films 807 having a gap 808 is formed in a portion formed by the first element electrode 806*a* and the second element electrode 806*b*. That is, the first element electrodes 806*a*, the second element electrodes 806*b*, and the conductive films 807 constitute the plurality of electron emission portions 805. Each of the conductive films 807 is constituted by palladium oxide (PdO). In each of the cathode electrodes 806, the gap 808 is formed by forming processing after the corresponding one of the conductive films 807 is formed.

An anode electrode 809 is formed on a lower surface of the second substrate 802 so as to face the cathode electrodes 806. A bank portion 811 is formed on a lower surface of the anode electrode 809 in a lattice. Fluorescent materials 813 are arranged in opening portions 812 which opens downward and which are surrounded by the bank portion 811. The fluorescent materials 813 correspond to the electron emission portions 805. Each of the fluorescent materials 813 emits fluorescent light having one of the three colors, red (R), green (G), and blue (B). Red fluorescent materials 813R, green fluorescent materials 813G, and blue fluorescent materials 813B are arranged in the opening portions 812 in a predetermined arrangement pattern described above.

The first substrate 801 and the second substrate 802 thus configured are attached with each other with a small gap therebetween. In this display apparatus 800, electrons emitted from the first element electrodes 806*a* or the second element electrodes 806*b* included in the cathode electrodes 806 hit the fluorescent materials 813 formed on the anode electrode 809 so that the fluorescent materials 813 are excited and emit light whereby display with colors is achieved.

As with the other embodiments, in this case also, the first element electrodes 806*a*, the second element electrodes 806*b*, the conductive films 807, and the anode electrode 809 may be formed using the liquid droplet ejection apparatus 1. In addition, the red fluorescent materials 813R, the green fluorescent materials 813G, and the blue fluorescent materials 813B may be formed using the liquid droplet ejection apparatus 1.

Figure 29A:
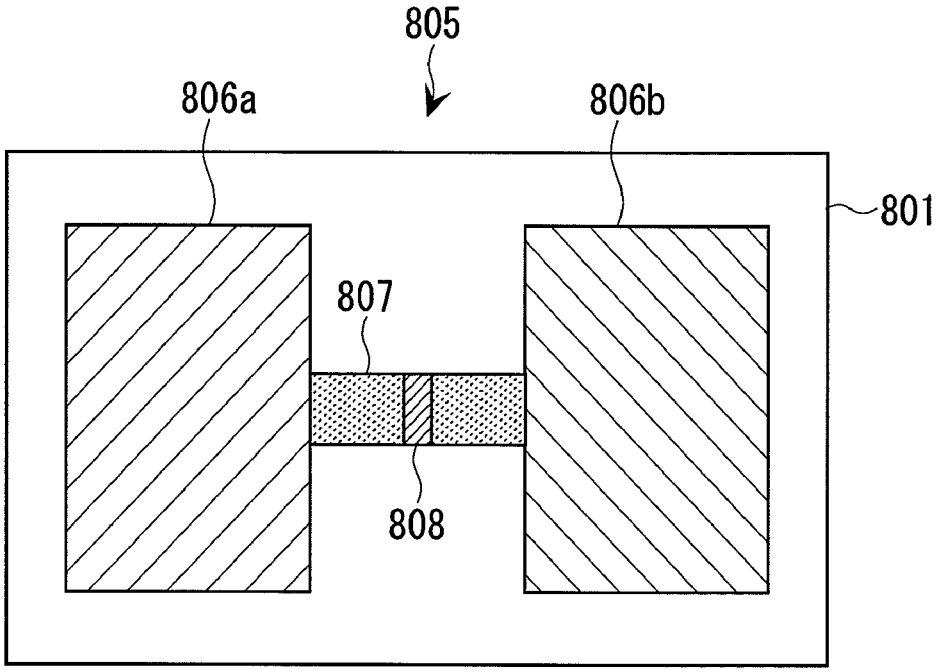
FIG. 29A is a plan view illustrating an electron emission portion and the vicinity thereof of a display apparatus.
Figure 29B:
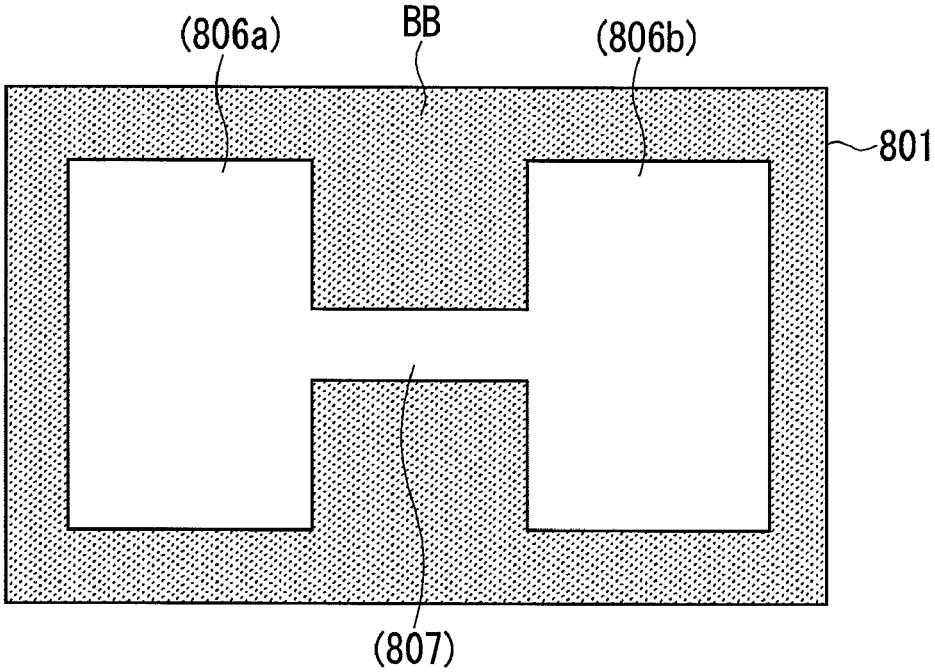
FIG. 29B is a plan view illustrating a method of forming the electron emission portion and the vicinity thereof.

Each of the first element electrodes 806*a*, each of the second element electrodes 806*b*, and each of the conductive films 807 have shapes as shown in FIG. 29A. When the first element electrodes 806*a*, the second element electrodes 806*b*, and the conductive films 807 are formed, portions for forming the first element electrodes 806*a*, the second element electrodes 806*b*, and the conductive films 807 are left as they are on the first substrate 801 and only bank portions BB are formed (by a photolithography method) as shown in FIG. 29B. Then, the first element electrodes 806*a* and the second element electrodes 806*b* are formed by an inkjet method using a solvent ejected from the liquid droplet ejection apparatus 1 in grooves defined by the bank portions BB and are formed by drying the solvent. Thereafter, the conductive films 807 are formed by the inkjet method using the liquid droplet ejection apparatus 1. After forming the conductive films 807, the bank portions BB are removed by ashing processing and the forming processing is performed. Note that, as with the case of the organic EL device, the hydrophilic treatment is preferably performed on the first substrate 801 and the second substrate 802 and the repellency treatment is preferably performed on the bank portion 811 and the bank portions BB.

Examples of other electro-optical apparatuses include an apparatus for forming metal wiring, an apparatus for forming a lens, an apparatus for forming a resist, and an apparatus for forming an optical diffusion body. Use of the liquid droplet ejection apparatus 1 makes it possible to efficiently manufacture various electro-optical apparatuses.

What is claimed is:

1. A suction device that is provided in an inkjet liquid droplet ejection apparatus to plot on a workpiece by a plurality of functional liquid droplet ejection heads and sucks functional liquid while contacting with nozzle surfaces of the functional liquid droplet ejection heads, the suction device comprising:

a plurality of head caps corresponding to the plurality of functional liquid droplet ejection heads;

a suction channel having a plurality of individual channels having their upstream sides connected to the plurality of head caps and a junction channel connected to downstream ends of the plurality of individual channels via a junction part;

a plurality of channel opening/closing unit that is disposed on the individual channels and opens and closes the respective individual channels;

a waste liquid tank connected to a downstream end of the junction channel and composed of a sealed tank;

an ejector having a primary side with compressed air introduced thereto, and a secondary side connected to an upper space of the waste liquid tank;

a pressure adjustment unit that adjusts pressure of the compressed air at the primary side of the ejector; and a control unit that controls the pressure adjustment unit, the control unit controlling the pressure adjustment unit according to a number of open-channel opening/closing units opened out of the plurality of channel opening/closing units such that a suction pressure is constant in the plurality of head caps.

2. The suction device according to claim 1, further comprising a pressure detection unit that detects pressure in each of the waste liquid tanks during suction, wherein the control unit controls the pressure adjustment unit such that the pressure in the waste liquid tanks is set to be a predetermined pressure according to the number of the channel opening/closing units opened.

3. The suction device according to claim 1, further comprising a flow rate detection unit that detects a flow rate of functional liquid flowing into each of the waste liquid tanks by suction, wherein the control unit controls the pressure adjustment unit such that the flow rate of the functional liquid flowing into the waste liquid tanks is set to be a predetermined flow rate according to the number of the channel opening/closing units opened.

4. The suction device according to claim 1, wherein the plurality of functional liquid droplet ejection heads is mounted on a single head plate and the plurality of head caps is mounted on a single cap plate in a manner corresponding to the functional liquid droplet ejection heads.

5. The suction device according to claim 1, wherein the plurality of functional liquid droplet ejection heads is mounted on a plurality of head plates and the plurality of head caps is mounted on a plurality of cap plates in a manner corresponding to the functional liquid droplet ejection heads.

6. A liquid droplet ejection apparatus comprising:

a plotting unit that plots on a workpiece by ejecting functional liquid droplets from a plurality of inkjet functional liquid droplet ejection heads while moving the functional liquid droplet ejection heads; and ion device set forth in claim 1.

7. An electro-optical apparatus comprising: a film formation portion formed on a workpiece with functional liquid droplets by using the liquid droplet ejection apparatus set forth in claim 6.

* * * * *